US010997895B2

(12) United States Patent
Bae et al.

(10) Patent No.: US 10,997,895 B2
(45) Date of Patent: May 4, 2021

(54) DISPLAY DRIVING METHOD ACCORDING TO DISPLAY CONFIGURATION AND ELECTRONIC DEVICE FOR SUPPORTING THE SAME

(71) Applicant: Samsung Electronics Co., Ltd., Gyeonggi-do (KR)

(72) Inventors: Jong Kon Bae, Seoul (KR); Dong Hwy Kim, Gyeonggi-do (KR); Hong Kook Lee, Seoul (KR); Dong Kyoon Han, Gyeonggi-do (KR); Yun Pyo Hong, Seoul (KR)

(73) Assignee: Samsung Electronics Co., Ltd

( * ) Notice: Subject to any disclaimer, the term of this patent is extended or adjusted under 35 U.S.C. 154(b) by 0 days.

(21) Appl. No.: 16/799,078

(22) Filed: Feb. 24, 2020

(65) Prior Publication Data

US 2020/0193894 A1 Jun. 18, 2020

Related U.S. Application Data

(63) Continuation of application No. 15/880,123, filed on Jan. 25, 2018, now Pat. No. 10,573,218.

(30) Foreign Application Priority Data

Jan. 25, 2017 (KR) ..... 10-2017-011925

(51) Int. Cl.
*G09G 3/20* (2006.01)
*G09G 3/36* (2006.01)

(52) U.S. Cl.
CPC ..... *G09G 3/2003* (2013.01); *G09G 3/3607* (2013.01); *G09G 3/3688* (2013.01); *G09G 3/3696* (2013.01); *G09G 2310/027* (2013.01); *G09G 2310/0243* (2013.01); *G09G 2310/0286* (2013.01); *G09G 2310/0291* (2013.01); *G09G 2310/0297* (2013.01);
(Continued)

(58) Field of Classification Search
CPC ..... G09G 2310/0291; G09G 2330/021; G09G 3/3607
See application file for complete search history.

(56) References Cited

U.S. PATENT DOCUMENTS 5,786,813 A 7/1998 Kurikko
2003/0117360 A1 6/2003 Bu
(Continued)

FOREIGN PATENT DOCUMENTS

KR 10-2003-0044809 6/2003
KR 10-2018-0108148 10/2018

*Primary Examiner* — Laurence J Lee
(74) *Attorney, Agent, or Firm* — The Farrell Law Firm, P, C,

(57) ABSTRACT

An electronic device is provided that includes a display panel including a plurality of source line groups including a plurality of source lines and a plurality of panel switches for each of the plurality of source lines; and a display driver integrated circuit (DDI) configured to drive the display panel, wherein the DDI includes the plurality of source amplifiers, decoders respectively connected to the plurality of source amplifiers, and at least one switch between source amplifier channels, wherein an operation of the at least one switch causes the number of the source line groups corresponding to a source amplifier to be changed.

16 Claims, 14 Drawing Sheets

(52) U.S. Cl.
CPC ..... *G09G 2320/0666* (2013.01); *G09G 2320/0673* (2013.01); *G09G 2330/02* (2013.01); *G09G 2330/021* (2013.01)

(56) References Cited

U.S. PATENT DOCUMENTS

| | | | | |
|---|---|---|---|---|
| 2011/0032240 | A1* | 2/2011 | Wang | G09G 3/2092 345/212 |
| 2016/0189601 | A1* | 6/2016 | Jung | G09G 3/20 345/212 |
| 2016/0321977 | A1* | 11/2016 | Kong | G09G 3/2003 |
| 2018/0182317 | A1* | 6/2018 | Cui | G09G 3/3607 |

* cited by examiner

DISPLAY DRIVING METHOD ACCORDING TO DISPLAY CONFIGURATION AND ELECTRONIC DEVICE FOR SUPPORTING THE SAME

PRIORITY

This application is a Continuation Application of U.S. application Ser. No. 15/880,123, now U.S. Pat. No. 10,573,218, which was filed in the U.S. Patent and Trademark Office on Jan. 25, 2018, which claims priority under 35 U.S.C. § 119(a) to Korean Patent Application Serial number 10-2017-011925, which was filed on Jan. 25, 2017 in the Korean Intellectual Property Office, the entire disclosure of which is incorporated herein by reference.

BACKGROUND

1. Field of the Disclosure

The present disclosure relates, generally, to a method of controlling a display of an electronic device, and more particularly, to a method of controlling a display based on a display configuration.

2. Description of the Related Art

Conventional electronic devices may include a display that is used for displaying information. Power consumption of the display is a relatively large part of the entire power consumption of the electronic device. Therefore, there exists a need for a method for reducing power consumption of an electronic device that includes a display, but which has limited power, e.g., a battery of the electronic device.

SUMMARY

The present disclosure has been made to address at least the disadvantages described above and to provide at least the advantages described below. Accordingly, an aspect of the present disclosure provides a display driving/operating method according to a display configuration for driving a display at a low power based on at least one of a display configuration of a function or content which is being executed, a display configuration according to a user input, or a display configuration requested by a system of an electronic device, and an electronic device for supporting the same.

Another aspect of the present disclosure provides methods and electronic devices which may enhance an image quality for a user while reducing overall power consumption by adaptively driving a display at a low power depending on display configuration and may facilitate the manufacture of a display driver integrated circuit (DDI) and an electronic device.

In accordance with an aspect of the present disclosure, there is provided an electronic device. The electronic device includes a display panel including a plurality of source line groups selectively connected with a plurality of source amplifiers and panel switches located between the plurality of source line groups and the plurality of source amplifiers and a display driver integrated circuit (DDI) configured to drive the display panel and including the plurality of source amplifiers, decoders respectively connected to the plurality of source amplifiers, a logic circuit configured to provide display data to the decoders, a gamma generator configured to supply a gamma voltage to the decoders, and at least one switch configured to selectively connect the plurality of source amplifiers with the plurality of source line groups.

In accordance with another aspect of the present disclosure, there is provided a display operating method for providing source signals of a plurality of source amplifiers to a plurality of source line groups in a time-sliced manner in an electronic device including the plurality of source line groups selectively connected with the plurality of source amplifiers and panel switches located between the plurality of source line groups and the plurality of source amplifiers. The method includes collecting information associated with a display configuration, controlling a turn-on state or a turn-off state of at least one switch which selectively connects an output of the plurality of source amplifiers based on the information associated with the display configuration, and controlling activation or deactivation of at least one source amplifier connected with an output of a specified source amplifier in response to the turn-on state or the turn-off state of the at least one switch.

BRIEF DESCRIPTION OF THE DRAWINGS

The above and other aspects, features and advantages of certain embodiments of the present disclosure will be more apparent from the following detailed description taken in conjunction with the accompanying drawings, in which.

Throughout the drawings, it should be noted that like reference numbers are used to depict the same or similar elements, features, and structures.

DETAILED DESCRIPTION

Figure 1:
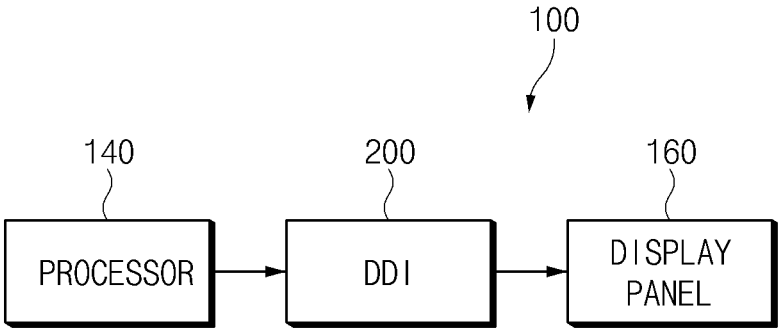
FIG. 1 is a block diagram of an electronic device including a display driver integrated circuit (DDI), according to an embodiment of the present disclosure.

Embodiments of the present disclosure will be described herein below with reference to the accompanying drawings.

However, the embodiments of the present disclosure are not limited to the specific embodiments and should be construed as including all modifications, changes, equivalent devices and methods, and/or alternative embodiments of the present disclosure.

The terms "have," "may have," "include," and "may include" as used herein indicate the presence of corresponding features (for example, elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may modify various elements regardless of an order and/or importance of the corresponding elements, and do not limit the corresponding elements. These terms may be used for the purpose of distinguishing one element from another element. For example, a first user device and a second user device may indicate different user devices regardless of the order or importance. For example, a first element may be referred to as a second element without departing from the scope the present invention, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The expression "configured to (or set to)" as used herein may be used interchangeably with "suitable for," "having the capacity to," "designed to," "adapted to," "made to," or "capable of" according to a context. The term "configured to (set to)" does not necessarily mean "specifically designed to" in a hardware level. Instead, the expression "apparatus configured to . . . " may mean that the apparatus is "capable of . . . " along with other devices or parts in a certain context. For example, "a processor configured to (set to) perform A, B, and C" may mean a dedicated processor (e.g., an embedded processor) for performing a corresponding operation, or a generic-purpose processor (e.g., a central processing unit (CPU) or an application processor (AP)) capable of performing a corresponding operation by executing one or more software programs stored in a memory device.

The terms used in describing the various embodiments of the present disclosure are for the purpose of describing particular embodiments and are not intended to limit the present disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding the embodiments of the present disclosure.

The term "module" as used herein may, for example, mean a unit including one of hardware, software, and firmware or a combination of two or more of them. The "module" may be interchangeably used with, for example, the term "unit", "logic", "logical block", "component", or "circuit". The "module" may be a minimum unit of an integrated component element or a part thereof. The "module" may be a minimum unit for performing one or more functions or a part thereof. The "module" may be mechanically or electronically implemented. For example, the "module" according to the present invention may include at least one of an application-specific integrated circuit (ASIC) chip, a field-programmable gate arrays (FPGA), and a programmable-logic device for performing operations which has been known or are to be developed hereinafter.

An electronic device according to the present disclosure may include at least one of, for example, a smart phone, a tablet personal computer (PC), a mobile phone, a video phone, an electronic book reader (e-book reader), a desktop PC, a laptop PC, a netbook computer, a workstation, a server, a personal digital assistant (PDA), a portable multimedia player (PMP), a MPEG-1 audio layer-3 (MP3) player, a mobile medical device, a camera, and a wearable device. The wearable device may include at least one of an accessory type (e.g., a watch, a ring, a bracelet, an anklet, a necklace, a glasses, a contact lens, or a head-mounted device (HMD)), a fabric or clothing integrated type (e.g., an electronic clothing), a body-mounted type (e.g., a skin pad, or tattoo), and a bio-implantable type (e.g., an implantable circuit).

The electronic device may be a home appliance. The home appliance may include at least one of, for example, a television, a digital video disk (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

The electronic device may include at least one of various medical devices (e.g., various portable medical measuring devices (a blood glucose monitoring device, a heart rate monitoring device, a blood pressure measuring device, a body temperature measuring device, etc.), a magnetic resonance angiography (MRA), a magnetic resonance imaging (MRI), a computed tomography (CT) machine, and an ultrasonic machine), a navigation device, a global positioning system (GPS) receiver, an event data recorder (EDR), a flight data recorder (FDR), a vehicle infotainment device, an electronic device for a ship (e.g., a navigation device for a ship, and a gyro-compass), avionics, security devices, an automotive head unit, a robot for home or industry, an automatic teller machine (ATM) in banks, point of sales (POS) devices in a shop, or an Internet of things (IoT) device (e.g., a light bulb, various sensors, electric or gas meter, a sprinkler device, a fire alarm, a thermostat, a streetlamp, a toaster, a sporting goods, a hot water tank, a heater, a boiler, etc.).

The electronic device may include at least one of a part of furniture or a building/structure, an electronic board, an electronic signature receiving device, a projector, and various kinds of measuring instruments (e.g., a water meter, an electric meter, a gas meter, and a radio wave meter). The electronic device may be a combination of one or more of the aforementioned various devices. The electronic device may also be a flexible device. Further, the electronic device is not limited to the aforementioned devices, and may include an electronic device according to the development of new technology.

Hereinafter, an electronic device will be described with reference to the accompanying drawings. In the present disclosure, the term "user" may indicate a person using an electronic device or a device (e.g., an artificial intelligence electronic device) using an electronic device.

FIG. 1 is a diagram of an electronic device including a display driver integrated circuit (DDI), according to an embodiment of the present disclosure.

Referring to FIG. 1, an electronic device 100 may include a processor (e.g., an AP), a DDI 200, and a display panel 160. The electronic device 100 may be, a portable electronic device. The DDI 200 and the display panel 160 may be a separate (or external) display device (or display module) from the processor 140. The electronic device 100 may turn off some source amplifiers while using an output of a specified source amplifier for a plurality of source channels assigned to the of the source amplifiers, i.e., when the DDI 200 includes a plurality of source amplifiers and where a plurality of source channels (or source lines or grouped source channels) are provided to be driven (or assigned) to each of the plurality of source amplifies. Thus, by operating only some source amplifiers, the electronic device 100 may operate the display panel 160 at a relatively lower power, when compared to operating all the source amplifiers. The electronic device 100 may also provide an optimum screen state, without deterioration in image quality, by operating the display panel 160 based on a driving frequency suitable for each display configuration.

The processor 140 may control an overall operation of the electronic device 100. The processor 140 may be an integrated circuit (IC), a system on chip (SoC), or a mobile AP. The processor 140 may transmit display data (e.g., image data, moving image data, or still image data) to be displayed to the DDI 200. The display data may be classified at intervals of line data corresponding to a horizontal line (or a vertical line) of the display panel 160. The processor 140 may transmit a control signal, which is associated with changing a driving frequency of the display panel 160, for controlling a switch operation for using outputs of specified source amplifiers depending on the changed driving frequency, for controlling to turn on or off of a gamma generator, or for controlling a source amplifier in a time-sliced manner, to the DDI 200.

The DDI 200 may change data transmitted from the processor 140 into a format capable of being transmitted to the display panel 160 and may transmit the changed data to the display panel 160. The changed data (or display data) may be provided on a pixel-by-pixel basis (or on a sub-pixel-by-sub-pixel basis). The pixel may have a structure where red, green, blue (RGB) sub-pixels are adjacent to each other, in connection with displaying a specified color, and one pixel may include RGB sub-pixels (in an RGB stripe layout structure) or may include RGBG sub-pixels (e.g., in a PenTile™ layout structure, which is a matrix used in an active matrix OLED (AMOLED)). A structure where RGBG sub-pixels are located may be replaced with a structure where RGBG sub-pixels are located. Alternatively, the pixel may be replaced with a structure where red, green, blue, white (RGBW) sub-pixels are located.

The DDI 200 may process display data provided to the display panel 160 on a pixel-by-pixel basis depending on display configuration and may use outputs of a plurality of source amplifiers to which a plurality of sub-pixels are assigned as outputs of other source amplifiers to which a plurality of sub-pixels are assigned. For example, the DDI 200 may turn off a second source amplifier depending on display configuration in a PenTile™ layout structure including an RGBG sub-pixel (e.g., a structure or state where a red sub-pixel and a blue sub-pixel are connected to a first source amplifier and where a first green sub-pixel and a second green sub-pixel are connected to the second amplifier) and may replace the output of the second source amplifier with the output of the first source amplifier. The above-mentioned DDI 200 may reduce power consumption while maintaining a screen recognition rate at a specified value (e.g., while maintaining luminance of a specified level) by turning off some source amplifiers; this will depend on at least one of display configuration associated with an executing function, display configuration according to a change in a state of the electronic device 100 (e.g., a sleep mode or an always on display (AOD) mode), or display configuration according to a user input and using a specified source amplifier.

Screens according to the display configuration may include a screen which outputs various types of objects. For example, a first screen according to display configuration may include a screen which outputs a moving image such as a movie. In this case, the DDI 200 may be driven at a relatively high first driving (or operating) frequency and may be operated by activating all of the source amplifiers. A second screen according to display configuration may include a screen where a webpage is displayed, a waiting screen, or a screen where a still image is output. In this case, the DDI 200 may be driven at a relatively low second driving frequency and may turn off some source amplifiers. A third screen according to display configuration may include a screen where at least one object having a relatively dull color and form is displayed on the display panel 160. For example, the third screen may include an AOD state for maintaining an always turn-on state. Alternatively, the third screen may include a screen which displays only a specified object (e.g., a timepiece object, an object for providing weather information, an object for displaying a received message (e.g., a chat message, a text message, an e-mail message, or the like), an object for displaying a missed call, and/or an object associated with a schedule, or the like) in a state where a background screen of a single color (or a specified number or less of colors) is output on the display panel 160 or a background is turned off while the display panel 160 is displayed at luminance of a specified level s according to occurrence of a specified event. In this case, the DDI 200 may be driven at a relatively low third driving frequency (e.g., a driving frequency lower than the second driving frequency).

When driving the third driving frequency, the number of source lines which use a specified source amplifier may increase (e.g., relatively more source lines than when operating the second driving frequency and relatively more source amplifiers than when the second driving frequency is operated to maintain a turn-off state) in the electronic device 100. Each of the first screen, the second screen, and the third screen may be a screen according to execution of a specified function supported by the electronic device 100. Each of the first screen, the second screen, and the third screen may be a screen output based on display configuration according to a user input.

The display panel 160 may display display data by the DDI 200. The display panel 160 may be a thin film transistor-liquid crystal display (TFT-LCD) panel, a light emitting diode (LED) display panel, an organic LED (OLED) display panel, an AMOLED, a flexible display panel, or the like.

In the display panel 160, gate lines and source lines intersect each other in the form of a matrix. A gate signal may be provided to the gate lines, and may be sequentially provided to gate lines. A first gate signal may be provided to odd gate lines among gate lines, and a second gate signal may be provided to even gate lines among the gate lines. The first gate signal and the second gate signal may include signals which are alternately provided. Alternatively, after the first gate signal is sequentially provided from a start line among odd gate lines to an end line among the odd gate lines, the second gate signal may be sequentially provided from a start line among even gate lines to an end line among the event gate lines. A signal corresponding to display data may be provided to the source lines. The signal corresponding to the display data may be provided from a source driver depending on control of a timing controller of a logic circuit.

The display panel 160 may include at least one panel switch such that a plurality of sub-pixels sequentially receive an output of one source amplifier. For example, in the case of an RGBG type of the display panel 160, a red sub-pixel and a blue sub-pixel may be selectively connected to the first source amplifier. Panel switches may be located between the red sub-pixel and the first source amplifier and between the blue sub-pixel and the first source amplifier. Alternatively, a first green sub-pixel and a second green sub-pixel may be selectively connected to the second source amplifier. Panel switches may be located between the first green sub-pixel and the second source amplifier and between the second green sub-pixel and the second source amplifier. As described above, in the display panel 160, panel switches which are turned on at the same time may correspond to each of the plurality of source channels, and each of the panel switches may be connected to an output of one source amplifier.

Figure 2:
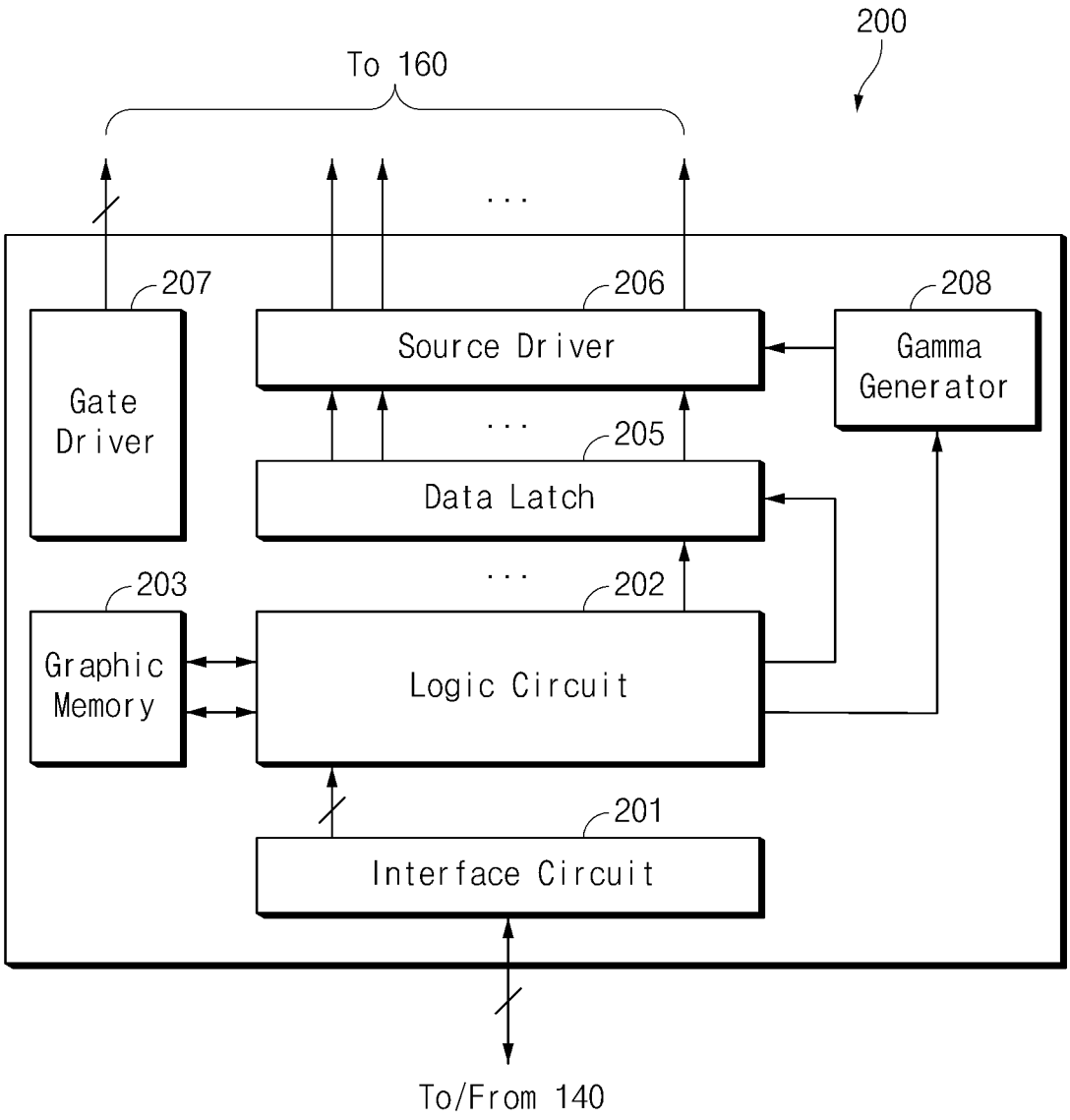
FIG. 2 is a block diagram of a DDI, according to an embodiment of the present disclosure.

FIG. 2 is a diagram of a DDI, according to an embodiment of the present disclosure.

The DDI 200 may include an interface circuit 201, a logic circuit 202, a graphic memory 203, a data latch 205 (or a shift register), a source driver 206, a gate driver 207, and a gamma generator 208 (or a gamma circuit).

The interface circuit 201 may interface signals or data transmitted and received between the processor 140 and the DDI 200. The interface circuit 201 may interface line data transmitted from the processor 140 to transmit the line data to a graphic memory write controller of the logic circuit 202. The interface circuit 201 may be an interface associated with a serial interface such as a mobile industry processor interface (MIPI®), a mobile display digital interface (MDDI), a display port (DP), or an embedded DP (eDP).

The logic circuit 202 may include the graphic memory write controller, a timing controller, a graphic memory read controller, an image processing unit, a source shift register controller, and a data shift register.

The graphic memory write controller of the logic circuit 202 may control receiving line data transmitted from the interface circuit 201 and writing the received line data in the graphic memory 203.

The timing controller may provide a synchronizing signal and/or a clock signal to each element (e.g., the graphic memory read controller) of the DDI 200. The timing controller may transmit a read command (RCMD) for controlling a read operation of the graphic memory 203 to the graphic memory read controller. The timing controller may provide display data of the source driver 206, and the timing controller may output a gate signal of the gate driver 207. The timing controller may control the gate driver 207 to sequentially provide a gate signal to gate signal lines of the display panel 160. Alternatively, the timing controller may control the gate controller 207 to divide odd lines and even lines among the gate signal lines of the display panel 160 and output a gate signal to the odd lines and the even lines.

The timing controller may generate and transmit a digital gamma value depending on display configuration. The timing controller may control the source driver 206 to provide an output of a specified source amplifier among the plurality of source amplifiers assigned to grouped pixels to other grouped pixels in response to control of the processor 140. The timing controller may control a source amplifier and the gamma generator 208 to output timing of the source amplifier (e.g., drive the source amplifier in a time-sliced manner) such that a gamma voltage to be supplied to a corresponding sub-pixel is supplied to the sub-pixel.

The processor 140 or the timing controller may transmit digital gamma values associated with grouped sub-pixels, generated by the gamma generator 208, to the source amplifier at specified timing. The timing controller may output timing of a source amplifier in a time-sliced manner to generate an output of the source amplifier based on a digital gamma value corresponding to display data for each sub-pixel and provide the generated output to the sub-pixel.

The graphic memory read controller may perform reading line data stored in the graphic memory 203. The graphic memory read controller may perform reading all or part of the line data stored in the graphic memory 203 based on the RCMD for line data. The graphic memory read controller may transmit all or part of line data read from the graphic memory 203 to the image processing unit. Although the graphic memory write controller and the graphic memory read controller are described to be divided for convenience of description, they may be implemented as one graphic memory controller.

The image processing unit may enhance image quality by processing all or part of the line data transmitted from the graphic memory read controller. The display data with the enhanced image quality may be transmitted to the timing controller, which may transmit the display data to the source driver 206 via the data latch 205.

The source shift register controller may control an operation of shifting data of the data shift register. The source shift register controller may control to write line data of the graphic memory 203 and perform image preprocessing of an image processing unit, in response to a command received from the processor 140.

The data shift register may shift display data transmitted through the source shift register controller, depending on control of the source shift register controller. The data shift register may sequentially transmit the shifted display data to the data latch 205.

The graphic memory 203 may store line data input through the graphic memory write controller depending on control of the graphic memory write controller. The graphic memory 203 may operate as a buffer memory in the DDI 200. The graphic memory 203 may include a graphic random access memory (GRAM).

The data latch 205 may store display data sequentially transmitted from the data shift register, and may transmit the stored display data to the source driver 206 at intervals of a horizontal line of the display panel 160.

The source driver 206 may transmit line data, transmitted from the data latch 205, to the display panel 160, and may include a plurality of source amplifiers connected to grouped sub-pixels (or for each channel corresponding to the grouped sub-pixels). The source amplifiers included in the source driver 206 may operate in a time-sliced manner to provide a signal to the grouped sub-pixels. For example, the source amplifiers included in the source driver 206 may be connected with the same or different types of a plurality of sub-pixels.

In the case of a PenTile™ type of display panel 160, a first source amplifier may provide a signal to one red sub-pixel and one blue sub-pixel, and a second source amplifier may be connected to one first green sub-pixel and one second green sub-pixel. Alternatively, in the case of a stripe type of display panel 160, a first source amplifier may be connected to a first red sub-pixel, a first blue sub-pixel, and a first green sub-pixel which are connected to a specified gate line, and a second source amplifier may provide a signal to a second red sub-pixel, a second blue sub-pixel, and a second green sub-pixel which are connected to a specified gate line. Alternatively, in the case of the stripe type of display panel 160, one source amplifier may provide a signal to grouped six sub-pixels.

The source driver 206 may include a plurality of decoders connected with input ends of source amplifiers to which grouped sub-pixels are connected. The decoders may be connected to an output (or output end) of the gamma generator 208 and an output (or output end) of the logic circuit 202 and may decode (or multiply) display data transmitted from the logic circuit 202 and a gamma value provided from the gamma generator 208. An output of each decoder may be connected to each source amplifier.

The source driver 206 may include switches that are located between the source amplifiers and grouped sub-pixels. The source driver 206 may also include switches for connecting a specified source amplifier with source lines to provide a source signal to the source lines rather than source amplifiers which are turned off. At least one switch included in the source driver 206 may be turned on or off in response to a control signal provided from the logic circuit 202 (e.g., a timing controller). Thus, the source driver 206 may reduce power consumption by activating only some of the plurality of source amplifiers assigned to grouped sub-pixels and driving the display panel 160.

The gate driver 207 may drive (or control, or supply a specific signal) gate lines of the display panel 160, and the gate driver 207 may sequentially provide a gate signal to the gate lines of the display panel 160 depending on a control of the logic circuit 202. Alternatively, the gate driver 207 may classify the gate lines of the display panel 160 into odd lines or even lines depending on a control of the logic circuit 202 and may provide a gate signal to the classified lines. As described above, as an operation of the pixels implemented in the display panel 160 is controlled by the source driver 206 and the gate driver 207, display data input from the processor 140 (or an image corresponding to the display data) may be displayed on the display panel 160.

The gamma generator 208 may generate and provide a gamma value (or a gamma voltage) associated with adjusting luminance of the display panel 160. The gamma generator 208 may generate an analog gamma value corresponding to at least one of a first color (e.g., red), a second color (e.g., green), or a third color (e.g., blue) and may provide the generated analog gamma value to the source driver 206. The analog gamma value may be generated based on a gamma curve stored in response to a specified color.

The gamma generator 208 may generate an analog gamma value for only some colors (e.g., red and green, blue and green, or blue or red) and may provide the generated analog gamma value to the source driver 206. If the gamma generator 208 generates and provides an analog gamma value corresponding to one color, the logic circuit 202 may calculate a digital gamma value associated with another color with respect to an analog gamma value of a specified color and may provide the calculated digital gamma value to the source driver 206.

The gamma generator 208 may generate different gamma values in a time-sliced manner in response to control of the logic circuit 202 and may provide the generated different gamma values to the source driver 206. The gamma generator 208 may generate a gamma voltage to each sub-pixel per one horizontal synchronous signal (Hsync) period and may provide the generated gamma voltage to the source driver 206. The one Hsync period may vary in length according to a driving frequency value of the display panel 160.

Figure 3:
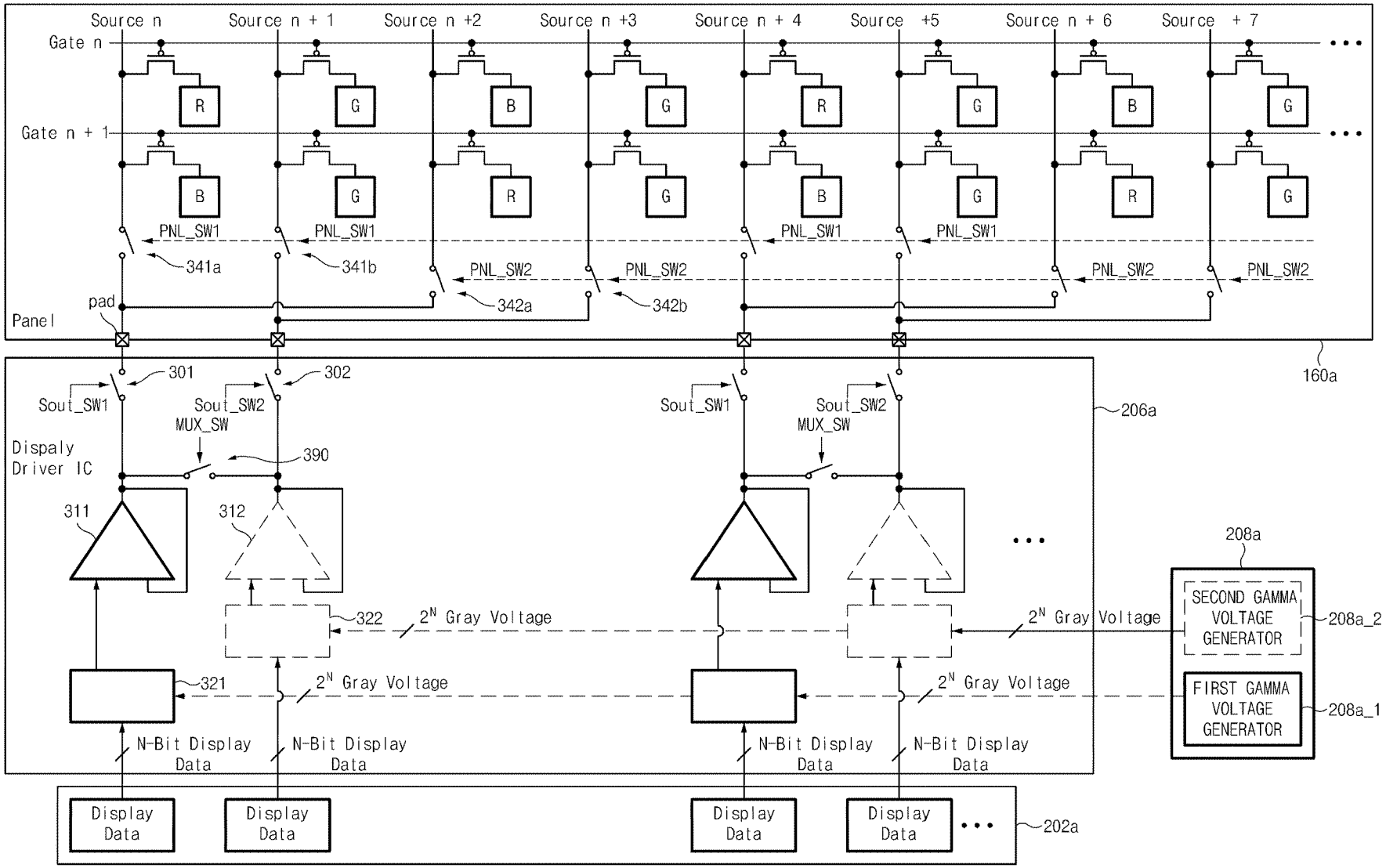
FIG. 3 is a diagram of an electronic device including a PenTile™ display panel, according to an embodiment of the present disclosure.

FIG. 3 is a diagram of an electronic device including a PenTile™ display panel, according to an embodiment of the present disclosure.

Referring to FIG. 3, the electronic device 100 of FIG. 1 may include a PenTile™ type of first display panel 160*a*, a first source driver 206*a*, a first gamma generator 208*a*, and a first logic circuit 202*a*.

The PenTile™ type of first display panel 160*a* may include a display region in which a plurality of gate lines Gates n and n+1 (where n is a natural number) and PenTile™ source lines Sources n to n+7 where four sub-pixels (e.g., RGBG sub-pixels) are repeatedly located to intersect each other. The first display panel 160*a* may include a non-display region where the first source driver 206*a*, which provides display data to the gate lines Gates n and n+1, and the PenTile™ source lines Sources n to n+7 and a gate driver 207, which provides a gate signal to the gate lines Gates n and n+1 and the PenTile™ source lines Sources n to n+7 are mounted. Alternatively, the DDI 200 may be located in the non-display region of the first display panel 160*a*.

Panel switches for switching outputs of source amplifiers to the sub-pixels may be located in an outer portion of the display region of the first display panel 160*a*. The panel switches may include a first panel switch 341*a* and a third panel switch 342*a* which are connected to a first source amplifier 311, and a second panel switch 341*b* and a fourth panel switch 342*b* which are connected to a second source amplifier 312. The electronic device 100 may further include source amplifiers connected with other sub-pixels which are not connected with the first source amplifier 211 and the second source amplifier 312. Similar to the first source amplifier 311 and the second source amplifier 312, the source amplifiers may be connected with grouped sub-pixels (e.g., a red sub-pixel and a blue sub-pixel or a first green sub-pixel and a second green sub-pixel). As described above, each of the source amplifiers may be selectively connected with the grouped sub-pixels through panel switches.

A gate signal may be sequentially provided to the gate lines Gates n and n+1. Alternatively, the gate lines Gates n and n+1 may include an odd gate line Gate n and an even gate line Gate n+1. A gate signal may be alternately provided to the odd gate line Gate n and the even gate line Gate n+1. The RGBG sub-pixels may form one pixel and may be repeatedly located on the odd gate line Gate n. BGRG sub-pixels may form one pixel and may be repeatedly located on the even gate line Gate n+1. An order of the RGBG may have substantially the same pattern as BGRG, and a start order or a last order may be differently located. A description will be given of an example in which a display panel is driven relative to the sub-pixels (e.g., RGBG sub-pixels) disposed in the gate line Gate n.

The PenTile™ source lines Sources n to n+7 (hereinafter, a description will be given relative to PenTile™ source lines Sources n to n+3) may include a first group channel (including the PenTile™ source lines Sources n and n+1) where a red sub-pixel and a blue sub-pixel are alternately located and a second group channel (including the PenTile™ source lines Sources n+1 and n+3) where a first green sub-pixel and a second green sub-pixel are alternately located. The above-mentioned PenTile™ source lines Sources n to n+3 may include a group of four sub-pixels included in one pixel. Pads connected with output ends of the source amplifiers (e.g., the first source amplifier 311 and the second source amplifier 312) of the first source driver 206*a* may be disposed at one side of the first display panel 160*a* at an end of each of the channels of the PenTile™ source lines Sources n to n+3.

The first source driver 206*a* may include the first source amplifier 311 for supplying a signal to the first group channel (including the PenTile™ source lines Sources n and n+2) among the PenTile™ source lines Sources n to n+3 and the second source amplifier 312 for supplying a signal to the second group channel (including the PenTile™ source lines Sources n+1 and n+3) among the PenTile™ source lines Sources n to n+3. The first source driver 206*a* may include a first switch 301 connected to an outer end of the first source amplifier 311, a second switch 302 connected to an output end of the second source amplifier 312, and a connection switch 390 disposed between the output end of the first source amplifier 311 and the output end of the second source amplifier 312. A control signal of each of the first switch 301, the second switch 302, and the connection switch 390 may be provided from a timing controller which receives a control signal from the processor 140. The first source driver 206*a* may include a first decoder 321 disposed at an input end of the first source amplifier 311 and a second decoder 322 disposed at an input end of the second source amplifier 312.

The first decoder 321 and the second decoder 322 may receive display data and a digital gamma value from the first logic circuit 202*a*. The first decoder 321 and the second decoder 322 may receive an output of the first gamma generator 208*a*.

The first gamma generator 208*a* may include a first gamma voltage generator 208*a*_1 and a second gamma voltage generator 208*a*_2. The first gamma voltage generator 208*a*_1 may generate an analog gamma value associated with a color of a first sub-pixel (e.g., a red sub-pixel) at a first period and may provide the generated analog gamma value to the first decoder 321.

The first gamma voltage generator 208*a*_1 may generate an analog gamma value associated with a color of a third sub-pixel (e.g., a blue sub-pixel) at a third period (e.g., an Hsync period subsequent to a second period) and may provide the generated analog gamma value to the first decoder 321.

The second gamma voltage generator 280*a*_2 may generate an analog gamma value associated with a color of each of the a second sub-pixel (e.g., a green sub-pixel) and a fourth sub-pixel (e.g., a green sub-pixel) during the second period (e.g., an Hsync period subsequent to the first period) and a fourth period (e.g., an Hsync period subsequent to the third period) and may provide the generated analog gamma value to the second decoder 322. The first gamma voltage generator 208*a*_1 may generate a gamma voltage associated with each of the first sub-pixel and the third sub-pixel in a first display configuration state in connection with driving the first display panel 160*a* and may supply the generated gamma voltage to the first decoder 321. The first gamma voltage generator 208*a*_1 may generate a gamma voltage associated with each of the first to four sub-pixels in a second display configuration state and may provide the generated gamma voltage to the first decoder 321.

The first logic circuit 202*a* may provide display data to each of the PenTile™ source lines Sources n to n+3 through the first decoder 321 and the second decoder 322 disposed for each group channel. The first logic circuit 202*a* may provide display data to the red sub-pixel through the first decoder 321 during a first period and may provide display data to a first green sub-pixel through the second decoder 322 during a second period. The first logic circuit 202*a* may provide display data to the blue sub-pixel through the first decoder 321 during a third period, and may provide display data to a second green sub-pixel through the second decoder 322 during a fourth period.

If the first logic circuit 202*a* provides display data corresponding to a red sub-pixel to the first decoder 321 during the first period (e.g., one Hsync period) based on the first display configuration (e.g., a configuration for driving a display panel based on a relatively high driving frequency), the first gamma voltage generator 208*a*_1 may supply a gamma voltage corresponding to the red sub-pixel to the first decoder 321. If an output of the first decoder 321 is provided to the first source amplifier 311, the first logic circuit 202*a* may activate the first switch 301 and the first panel switch 341*a*, which are disposed between the first source amplifier 311 and the red sub-pixel, based on a first switch control signal Sout_SW1 and a first panel switch control signal PNL_SW1 (the third panel switch 342*a* may be turned on in response to this operation). An output of the first source amplifier 311 may be provided to the red sub-pixel during the first period.

The first logic circuit 202*a* may provide display data corresponding to the first green sub-pixel to the second decoder 322 during the second period (e.g., an Hsync period subsequent to the first period). The second gamma voltage generator 208*a*_2 may supply a gamma voltage corresponding to the first green sub-pixel to the second decoder 322. If an output of the second decoder 322 is provided to the second source amplifier 312, the first logic circuit 202*a* may activate the second switch 302 and the second panel switch 341*b*, which are located between the second source amplifier 312 and the first green sub-pixel, based on a second switch control signal Sout_SW2 and a second panel switch control signal PNL_SW2 (the fourth panel switch 342*b* may be turned on in response to this operation). An output of the second source amplifier 312 may be provided to the first green sub-pixel during the second period.

The first logic circuit 202*a* may provide display data corresponding to the blue sub-pixel to the first decoder 321 during the third period (e.g., an Hsync period subsequent to the second period). The first gamma voltage generator 208*a*_1 may supply a gamma voltage corresponding to the blue sub-pixel to the first decoder 321. If an output of the first decoder 321 is provided to the first source amplifier 311, the first logic circuit 202*a* may activate the first switch 301 and the third panel switch 342*a*, which are located between the first source amplifier 311 and the blue sub-pixel, based on the first switch control signal Sout_SW1 and the first panel switch control signal PNL_SW1 (the first panel switch 341*a* may be turned on in response to this operation). An output of the first amplifier 311 may be provided to the blue sub-pixel during the third period.

The first logic circuit 202*a* may provide display data corresponding to the second green sub-pixel to the second decoder 322 during the fourth period (e.g., an Hsync period subsequent to the third period). The second gamma voltage generator 208_2 may supply a gamma voltage corresponding to the second green sub-pixel to the second decoder 322. If an output of the second decoder 322 is provided to the second source amplifier 312, the first logic circuit 202*a* may activate the second switch 302 and the second panel switch 341*b*, which are located between the second source amplifier 312 and the second green sub-pixel, based on the second switch control signal Sout_SW2 and the second panel switch control signal PNL_SW2 (the fourth panel switch 342*b* may be turned on in response to this operation). An output of the second source amplifier 312 may be provided to the second green sub-pixel during the fourth period.

In the above description, it is assumed that one pixel (e.g., a group of RGBG sub-pixels) is driven. However, the present disclosure is not so limited. For example, in the first display panel 160*a* in which a plurality of pixels are located, the first logic circuit 202*a* may provide display data to PenTile™ source lines corresponding to each of the plurality of pixels.

According to the second display configuration (e.g., a configuration for driving a display panel based on a relatively lower driving frequency than the first display configuration), the first source amplifier 311 may receive a signal obtained by decoding a gamma voltage corresponding to the red sub-pixel, provided to the first decoder 321 at the first gamma voltage generator 208*a*_1, and may display data provided to the first decoder 321 at the first logic circuit 202*a*. The first logic circuit 202*a* may activate the first switch 301 and the first panel switch 341*a*, which are located between the first source amplifier 311 and the red sub-pixel, based on the first switch control signal Sout_SW1 and the first panel switch control signal PNL_SW1 such that an output of the first source amplifier 311 is provided to the red sub-pixel during the first period (e.g., a specified one Hsync period). The first display panel 160*a* is driven according to the second display configuration, and the first logic circuit 202*a* may control the second source amplifier 312 to be in a turn-off state. An Hsync period according to the second display configuration may be longer than an Hsync period according to the first display configuration, and the first logic circuit 202*a* may turn off the second source amplifier 312 during the first period.

The first logic circuit 202*a* may provide display data corresponding to the first green sub-pixel to the first decoder 321 during the second period (e.g., a second Hsync period) subsequent to the first period. The first gamma voltage generator 208*a*_1 may supply a gamma voltage corresponding to the first green sub-pixel to the first decoder 321. The first gamma voltage generator 208_1 may generate a gamma voltage corresponding to each of the red sub-pixel, the blue sub-pixel, the first green sub-pixel, and the second green sub-pixel, or may generate a gamma value corresponding to each of the first and second green sub-pixels by mapping a gamma value of the red sub-pixel or the blue sub-pixel to a gamma value of the first green sub-pixel or the second green sub-pixel. During the second period, the first logic circuit 202*a* may activate the connection switch 390 located between the first source amplifier 311 and the second source amplifier 312, based on a connection switch control signal MUX_SW. The first logic circuit 202*a* may activate the second switch 302 and the second panel switch 341*b*, which are located between the second source amplifier 312 and the first green sub-pixel, based on the second switch control signal Sout_SW2 and the second panel switch control signal PNL_SW2. An output of the first source amplifier 311 may be provided to the first green sub-pixel during the second period. The first logic circuit 202*a* may turn off the second source amplifier 312 during the second period.

If receiving display data corresponding to the blue sub-pixel from the first logic circuit 202*a* during the third period (e.g., a third Hsync period) subsequent to the second period, the first decoder 321 may receive and decode a gamma voltage corresponding to the blue sub-pixel from the first gamma voltage generator 208_1 and may provide the decoded signal to the first source amplifier 311. The first logic circuit 202*a* may activate the first switch 301 and the third panel switch 342*a*, which are located between the first source amplifier 311 and the blue sub-pixel, based on the first switch control signal Sout_SW1 and the first panel switch control signal PNL_SW1. An output of the first source amplifier 311 may be provided to the blue sub-pixel during the third period. The first logic circuit 202*a* may turn off the connection state of a turn-on state or may maintain a turn-off state of the connection switch 390. The first logic circuit 202*a* may turn off the second source amplifier 312 during the third period.

The first decoder 321 may receive and decode display data corresponding to the second green sub-pixel from the first logic circuit 202*a* and may receive and decode a gamma voltage corresponding to the second green sub-pixel from the first gamma voltage generator 208*a*_1, during the fourth period (e.g., a fourth Hsync period) subsequent to the third period. The first decoder 321 may also provide the decoded signal to the first source amplifier 311. The first logic circuit 202*a* may turn on the connection switch 390, which are located between the first source amplifier 311 and the second source amplifier 312, based on the connection switch control signal MUX_SW and may activate the second switch 302 and the second panel switch 341*b*, which are located between the second source amplifier 312 and the second green sub-pixel, based on the second switch control signal Sout_SW2 and the second panel switch control signal PNL_SW2. An output of the first source amplifier 311 may be provided to the second green sub-pixel during the fourth period. The first logic circuit 202*a* may turn off the second source amplifier 312 during the fourth period.

As described above, the electronic device 100 may reduce basic power consumption to drive (or control, or supply a specific signal) source amplifiers. The electronic device 100 may also enhance the entire power consumption of the electronic device 100 by operating one source amplifier to drive one pixel (e.g., one pixel configured with four sub-pixels) depending on the second display configuration and maintaining some other source amplifiers in a turn-off state.

Figure 4:
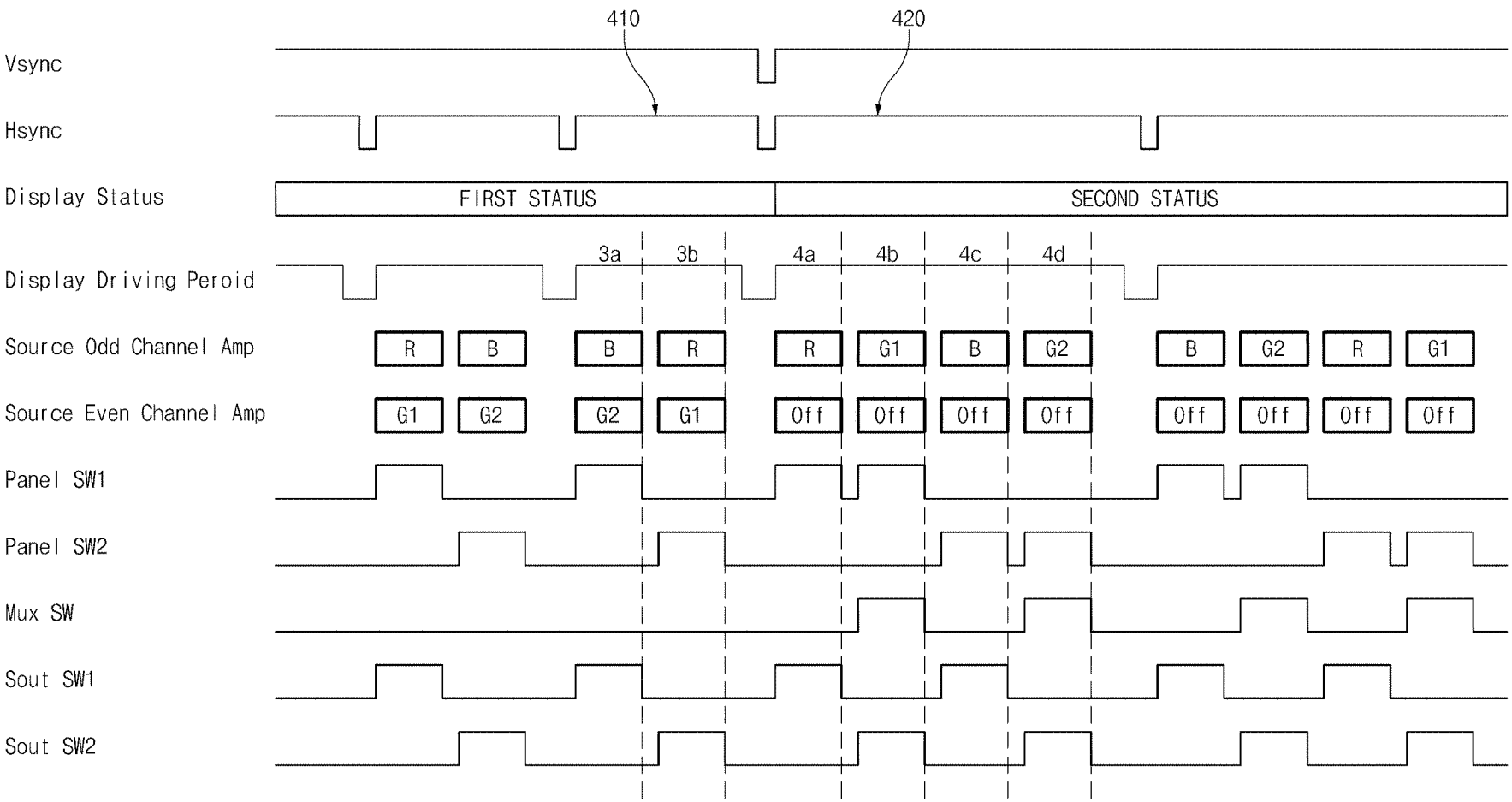
FIG. 4 is a diagram of a scheme for driving a PenTile™ display panel, according to an embodiment of the present disclosure.

FIG. 4 is a diagram of a scheme for driving a PenTile™ display panel, according to an embodiment of the present disclosure.

Referring to FIGS. 3 and 4, the first display panel 160*a* may operate in a first status 410 and a second status 420. The first status 410 may include a status for driving the first display panel 160*a* based on a relatively higher driving frequency than the second status 420. A driving frequency of the first display panel 160*a* in the first status 410 may be 60 Hz, and a driving frequency of the first display panel 160*a* in the second status 420 may be 30 Hz. Alternatively, the driving frequency of the first display panel 160*a* in the first status 410 may be 30 Hz, and the driving frequency of the first display panel 160*a* in the second status 420 may be 15 Hz. Alternatively, the driving frequency of the first display panel 160*a* in the first status 410 may be 45 Hz, and the driving frequency of the first display panel 160*a* in the second status 420 may be 30 Hz. If driving frequencies differ from each other, an Hsync may vary in length for each driving frequency.

The first display panel 160*a* may be changed from the first status 410 to the second status 420 or from the second status 420 to the first status 410, in response to a user setting, a type of an executed function, or a change in a state of an electronic device (e.g., AOD mode transition in a wake-up state, wake-up state transition in an AOD mode, or the like). A synchronous signal of the first display panel 160*a* may include a vertical synchronous signal (Vsync) and an Hsync. A plurality of horizontal synchronous signals may be located within one vertical synchronous signal. The number of the plurality of horizontal synchronous signals may vary according to a level of a driving frequency of the first display panel 160*a*.

A first logic circuit 202*a* associated with driving the first display panel 160*a* may include a source odd channel amplifier (e.g., the first amplifier 311) and a source even channel amplifier (e.g., the second source amplifier 312). At least one switch may be located in the first logic circuit 202*a* and the first display panel 160*a* in connection with driving the first display panel 160*a*. For example, the at least one switch may include the first panel switch 341*a* and the third panel switch 342*a* connected between a red sub-pixel and an output end of the first source amplifier 311 and between a blue sub-pixel and an output end of the second source amplifier 312. The at least one switch may include the second panel switch 341*b* and the fourth panel switch 342*b* connected between a first green sub-pixel and the output end of the second source amplifier 312 and between a second green sub-pixel and the output end of the second source amplifier 312. The at least one switch may also include the first switch 301 connected to the output end of the first source amplifier 311, the second switch 302 connected to the output end of the second source amplifier 312, and the connection switch 390.

In a first interval 3*a* of the first status 410, the first source amplifier 311 may output a signal for blue sub-pixel emission, and the second source amplifier 312 may output a signal for second green sub-pixel emission. The first logic circuit 202*a* may turn on the first panel switch 341*a* and may turn off the second panel switch 341*b*, based on a first panel switch control signal PNL_SW1 and a second panel switch control signal PNL_SW2 in the first interval 3*a*. The first logic circuit 202*a* may turn on the first switch 301 and may turn off the second switch 302, based on a first switch control signal Sout_SW1 and a second switch control signal Sout_SW2 in the first interval 3*a*. A signal of the first source amplifier 311 may be provided to the blue sub-pixel, and the blue sub-pixel may be lit.

In a second interval 3*b* of the first status 410, the first source amplifier 311 may output a signal associated with the red sub-pixel and the second source amplifier 312 may output a signal associated with the first green sub-pixel. The first logic circuit 202*a* may turn off the first panel switch 341*a* and may turn on the second panel switch 341*b*, based on the first panel switch control signal PNL_SW1 and the second panel switch control signal PNL_SW2 in the second interval 3*b*. The first logic circuit 202*a* may turn off the first switch 301 and may turn on the second switch 302, based on the first switch control signal Sout_SW1 and the second switch control signal Sout_SW2 in the second interval 3*b*. A signal of the second source amplifier 312 may be provided to the first green sub-pixel, and the first green sub-pixel may be lit.

In a first interval 4*a* of the second status 420, the first source amplifier 311 may output a signal associated with the red sub-pixel and the second source amplifier 312 may have a turn-off state. The first logic circuit 202*a* may turn on the first panel switch 341*a* and may turn off the second panel switch 341*b*, based on the first panel switch control signal PNL_SW1 and the second panel switch control signal PNL_SW2 in the first interval 4*a*. The first logic circuit 202*a* may turn on the first switch 301 and may turn off the second switch 302, based on the first switch control signal Sout_SW1 and the second switch control signal Sout_SW2 in the first interval 4*a*. A signal of the first source amplifier 311 may be provided to the red sub-pixel, and the red sub-pixel may be lit.

In a second interval 4*b* of the second status 420, the first source amplifier 311 may output a signal associated with the first green sub-pixel and the second source amplifier 312 may have the turn-off state. According to the first panel switch control signal PNL_SW1 and the second panel switch control signal PNL_SW2 in the second interval 4*b*, the first panel switch 341*a* may be in a turn-on state and the second panel switch 341*b* may have a tune-off state. According to the first switch control signal Sout_SW1 and the second switch control signal Sout_SW2 in the second interval 4*b*, the first switch 301 may be in a turn-off state and the second switch 302 may have a turn-on state. A signal of the first source amplifier 311 may be provided to the first green sub-pixel, and the first green sub-pixel may be lit.

In a third interval 4*c* of the second status 420, the first source amplifier 311 may output a signal associated with the blue sub-pixel and the second source amplifier 312 may have the turn-off state. According to the first panel switch control signal PNL_SW1 and the second panel switch control signal PNL_SW2 in the third interval 4*c*, the first panel switch 341*a* may be in a turn-off state and the second panel switch 341*b* may have a tune-on state. According to the first switch control signal Sout_SW1 and the second switch control signal Sout_SW2 in the third interval 4*c*, the first switch 301 may be in a turn-on state and the second switch 302 may have a turn-off state. A signal of the first source amplifier 311 may be provided to the blue sub-pixel, and the blue sub-pixel may be lit.

In a fourth interval 4*d* of the second status 420, the first source amplifier 311 may output a signal associated with the second green sub-pixel and the second source amplifier 312 may have the turn-off state. According to the first panel switch control signal PNL_SW1 and the second panel switch control signal PNL_SW2 in the fourth interval 4*d*, the first panel switch 341*a* may be in the turn-off state and the second panel switch 341*b* may have the tune-on state. According to the first switch control signal Sout_SW1 and the second switch control signal Sout_SW2 in the fourth interval 4*d*, the first switch 301 may be in the turn-off state and the second switch 302 may have the turn-on state. A signal of the first source amplifier 311 may be provided to the second green sub-pixel, and the second green sub-pixel may be lit.

Figure 5:
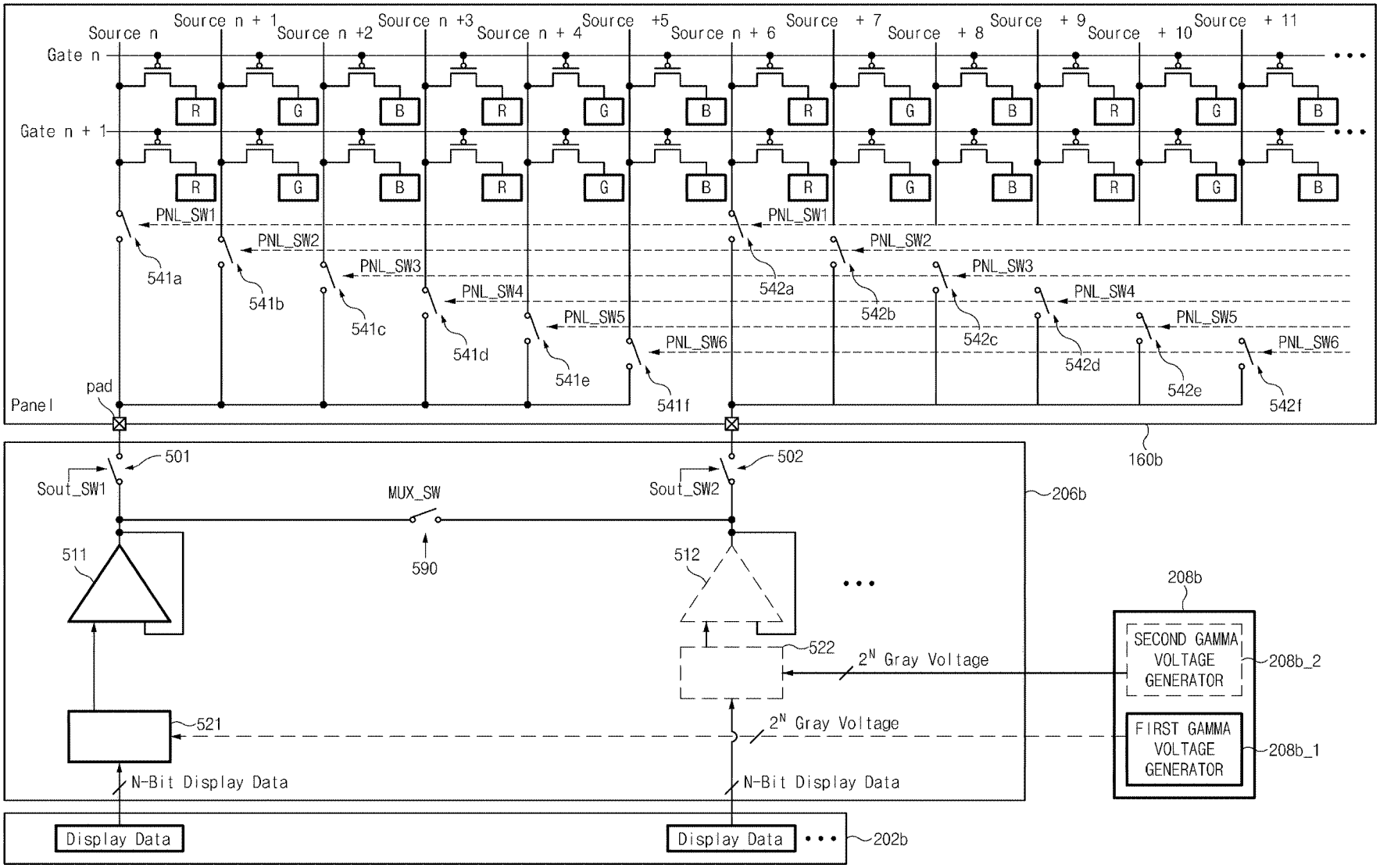
FIG. 5 is a diagram of an electronic device including a stripe layout type of a second display panel, according to an embodiment of the present disclosure.

FIG. 5 is a diagram of an electronic device including a stripe layout type of a second display panel, according to an embodiment of the present disclosure.

Referring to FIG. 5, the electronic device 100 of FIG. 1 may include a stripe layout type of second display panel 160*b*, a second source driver 206*b*, a second gamma generator 208*b*, and a second logic circuit 202*b*.

The stripe layout type of the second display panel 160*b* may include a display region in which a plurality of gate lines Gates n and n+1 and a plurality of stripe source lines Sources n to n+11 intersect each other. The second display panel 160*b* may include a non-display region where the second source driver 206*b*, which provides display data to the gate lines Gates n and n+1, and the stripe source lines Sources n to n+11 and a gate driver 207, which provides a gate signal to the gate lines Gates n and n+1 and the stripe source lines Sources n to n+11 are mounted. A pixel in the stripe layout type of second display panel 160*b* may include a form in which two pixels (e.g., two groups of sub-pixels of three RGB colors) are grouped.

A gate signal may be sequentially provided to the gate lines Gates n and n+1. Alternatively, the gate lines Gate n and n+1 may include an odd gate line Gate and an even gate line Gate n+1. A gate signal may be alternately provided to the odd gate line Gate n and an even gate line Gate n+1. Pixels located in the odd gate line Gate n and the even gate line Gate n+1 may be grouped by n.

Red sub-pixels, green sub-pixels, or blue sub-pixels may be located in the stripe source lines Sources n to n+11. Pads connected with output ends of source amplifiers of the second source driver 206*b* may be located at one side of the second display panel 160*b* at ends of some of the stripe source lines Sources n to n+11 (or at ends of some channels if the stripe source lines Sources n to n+11 are represented as channels). A plurality of panel switches may be located between the stripe source lines Sources n to n+11 and the pads. In connection with grouped two pixels (or six (RGBRGB) sub-pixels), the panel switches may include a first panel switch 541*a* located between the first source line Source n and the pad, a second panel switch 541*b* located between the second source line Source n+1 and the pad, a third panel switch 541*c* located between the third source line Source n+2 and the pad, a fourth panel switch 541*d* located between the fourth source line Source n+3 and the pad, a fifth panel switch 541*e* located between the fifth source line Source n+4 and the pad, and a sixth panel switch 541*f* located between the sixth source line Source n+5 and the pad. The first to sixth panel switches 541*a* to 541*f* may be connected to an output end of a first source amplifier 511 via a first switch 501 which operates based on a first switch control signal Sout_SW1.

In connection with grouped two other pixels adjacent to the grouped two pixels, the panel switches may include a seventh panel switch 542*a* located between the seventh source line Source n+6 and the pad, an eighth panel switch 542*b* located between the eighth source line Source n+7 and the pad, a ninth panel switch 542*c* located between the ninth source line Source n+8 and the pad, a tenth panel switch 542*d* located between the tenth source line Source n+9 and the pad, an eleventh panel switch 542*e* located between the eleventh source line Source n+10 and the pad, and a twelfth panel switch 542*f* located between the twelfth source line Source n+11 and the pad. The seventh to twelfth panel switches 542*a* to 542*f* may be connected to an output end of a second source amplifier 512 via a second switch 502 which operates based on a second switch control signal Sout_SW2. At least one of the first switch 501 and the second switch 502 may be located in the non-display region of the second display panel 160*b* or a second source driver 206*b*.

The first panel switch 541*a* and the seventh panel switch 542*a* may be turned on or off by the same first panel switch control signal PNL_SW1. Similarly, the second panel switch 541*b* and the eighth panel switch 542*b* may be turned on or off by the same second panel switch control signal PNL_SW2. The third panel switch 541*c* and the ninth panel switch 542*c* may be turned on or off by the same third panel switch control signal PNL_SW3. The fourth panel switch 541*d* and the tenth panel switch 542*d* may be turned on or off by the same fourth panel switch control signal PNL_SW4. The fifth panel switch 541*e* and the eleventh panel switch 542*e* may be turned on or off by the same fifth panel switch control signal PNL_SW5. The sixth panel switch 541*f* and the twelfth panel switch 542*f* may be turned on or off by the same sixth panel switch control signal PNL_SW6.

The second source driver 206*b* may include the first source amplifier 511 for selectively providing a signal to a first channel (including the stripe source lines Sources n to n+5) and the second source amplifier 512 for selectively providing a signal to a second channel (including the stripe source lines Sources n+6 to n+11). As described above, the second source driver 206*b* may include a plurality of source amplifiers for selectively providing a signal to six sub-pixels. The second source driver 206*b* may include the first switch 501 connected to an output end of the first source amplifier 511, the second switch 502 connected to an output end of the second source amplifier 512, and a connection switch 590 connected between the output end of the first source amplifier 511 and the output end of the second source amplifier 512.

A control signal of each of the first switch 501, the second switch 502, and the connection switch 590 may be provided from a timing controller which receives a control signal of the processor 140 of FIG. 1. The second source driver 206*b* may include a first decoder 521 located at an input end of the first source amplifier 511 and a second decoder 522 located at an input end of the second source amplifier 512. The first decoder 521 and the second decoder 522 may receive display data from the second logic circuit 202*b*. The first decoder 521 and the second decoder 522 may receive a gamma value corresponding to sub-pixels of the second gamma generator 208*b* (e.g., an output (or a gamma voltage) of a first gamma voltage generator 208*b*_1 and an output (or a gamma voltage) of a second gamma voltage generator 208*b*_2).

The second gamma generator 208*b* may include the first gamma voltage generator 208*b*_1 for generating each of analog gamma values associated with colors of first to sixth sub-pixels (e.g., RGBRGB sub-pixels) and providing the generated analog gamma value to the first decoder 521 and the second gamma voltage generator 208*b*_2 for generating each of analog gamma values associated with colors of seventh to twelfth sub-pixels (e.g., RGBRGB sub-pixels) and providing the generated analog gamma value to the second decoder 522. The DDI 200 of FIG. 2 may include the first gamma voltage generator 208_1. The one first gamma voltage generator 208*b*_1 may sequentially provide a gamma voltage to source amplifiers.

The second logic circuit 202*b* may provide display data to each of the stripe source lines Sources n to n+11 through the first decoder 521 and the second decoder 522 respectively located for the first source amplifier 511 and the second source amplifier 512. In the above description, six sub-pixels are grouped and as one source amplifier and one decoder are located for each of the grouped sub-pixels; however, the present disclosure is not so limited. For example, as sub-pixels are increased, a source amplifier and a decoder for outputting a specified signal to each group may also be increased in response to the increased sub-pixels.

When the second display panel 160*b* is driven according to the first display configuration, the second logic circuit 202*b* may provide display data of a first sub-pixel (e.g., a red sub-pixel) located on a specified gate line in the first source line Source n to the first decoder 521 during a first period (e.g., one Hsync period) among a plurality of periods associated with driving the second display panel 160*b*. The first gamma voltage generator 208*b*_1 may generate a gamma voltage associated with the first sub-pixel and may supply the generated gamma voltage to the first decoder 521. The first decoder 521 may decode the provided display data and the supplied gamma voltage and may provide the decoded signal to the first source amplifier 511. The first source amplifier 511 may amplify the received signal and may provide the amplified signal to the first sub-pixel. In this regard, the second logic 202*b* may turn on the first panel switch 541*a* and the first switch 501 based on the first panel switch control signal PNL_SW1 and the first switch control signal Sout_SW1.

During a second period subsequent to the first period, the first decoder 521 may receive display data to be provided to a second sub-pixel (e.g., a green sub-pixel) located on the second source line Source n+1 from the second logic circuit 202*b*, and may receive a gamma voltage associated with the second sub-pixel from the first gamma voltage generator 208*b*_1, thus decoding the received display data and the received gamma voltage. If the second panel switch 541*b* and the first switch 501 are turned on in response to a control signal of the second logic circuit 202*b* (e.g., the second panel switch control signal PNL_SW2 and the first switch control signal Sout_SW1), the first source amplifier 511 may amplify the signal decoded in connection with the second sub-pixel and may provide the amplified signal to the second sub-pixel.

During a third period subsequent to the second period, the first decoder 521 may receive display data to be provided to a third sub-pixel (e.g., a blue sub-pixel) located on the third source line Source n+2 from the second logic circuit 202*b*, and may receive a gamma voltage associated with the third sub-pixel from the first gamma voltage generator 208*b*_1, thus decoding the received display data and the received gamma voltage. If the third panel switch 541*c* and the first switch 501 are turned on in response to a control signal of the second logic circuit 202*b* (e.g., the third panel switch control signal PNL_SW3 and the first switch control signal Sout_SW1), the first source amplifier 511 may amplify the signal decoded in connection with the third sub-pixel and may provide the amplified signal to the third sub-pixel.

Similarly, during a fourth period, the first decoder 521 may receive and decode display data to be provided to a fourth sub-pixel (e.g., a red sub-pixel) and a gamma voltage associated with the fourth sub-pixel, and may transmit the decoded signal to the first source amplifier 511. If the fourth panel switch 541*d* and the first switch 501 are turned on in response to a control signal of the second logic circuit 202*b* (e.g., the fourth panel switch control signal PNL_SW4 and the first switch control signal Sout_SW1), the first source amplifier 511 may provide an amplified signal to the fourth sub-pixel.

During a fifth period, the first decoder 521 may receive and decode display data to be provided to a fifth sub-pixel (e.g., a green sub-pixel) and a gamma voltage associated with the fourth sub-pixel, and may transmit the decoded signal to the first source amplifier 511. If the fifth panel switch 541*e* and the first switch 501 are turned on in response to a control signal of the second logic circuit 202*b* (e.g., the fifth panel switch control signal PNL_SW5 and the first switch control signal Sout_SW1), the first source amplifier 511 may provide an amplified signal to the fifth sub-pixel.

During a sixth period, the first decoder 521 may receive and decode display data to be provided to a sixth sub-pixel (e.g., a blue sub-pixel) and a gamma voltage associated with the sixth sub-pixel, and may transmit the decoded signal to the first source amplifier 511. If the sixth panel switch 541*f* and the first switch 501 are turned on in response to a control signal of the second logic circuit 202*b* (e.g., the sixth panel switch control signal PNL_SW6 and the first switch control signal Sout_SW1), the first source amplifier 511 may provide an amplified signal to the sixth sub-pixel.

During a seventh period, the second decoder 522 may receive display data to be provided to a seventh sub-pixel from the second logic circuit 202*b*, and may receive a gamma voltage associated with the seventh sub-pixel from the second gamma voltage generator 208*b*_2, thus decoding the received display data and the received gamma voltage. The second decoder 522 may transmit the decoded signal to the second source amplifier 512. If the seventh panel switch 542*a* and the second switch 502 are turned on in response to a control signal of the second logic circuit 202*b* (e.g., the seventh panel switch control signal PNL_SW7 and the second switch control signal Sout_SW2), the second source amplifier 512 may amplify a decoded signal and may provide the amplified signal to the seventh sub-pixel. During eighth to twelfth periods, the second source amplifier 512 may provide an amplified signal to each of sub-pixels depending on control of panel switches which are sequentially turned on.

When the second display panel 160*b* is driven according to the second display configuration (e.g., a configuration for driving the second display panel 160*b* at a relatively lower driving frequency than the first display configuration), the second display 160*b* may be the same as the first to sixth periods described above in the first display configuration during the first to sixth periods among a plurality of Hsync periods.

In the seventh period subsequent to the sixth period, the second logic circuit 202*b* may turn on the connection switch 590, connected between the output end of the first source amplifier 511 and the output end of the second source amplifier 512, based on a connection switch control signal MUX_SW. The second logic circuit 202*b* may block the supply of power to the second source amplifier 512 and the second decoder 522 and may drive the seventh to twelfth sub-pixels using the first source amplifier 511 and the first decoder 521. The first gamma voltage generator 208*b*_1 may generate a gamma voltage associated with the first to sixth sub-pixels during the first to sixth periods and may generate a gamma voltage associated with the seventh to the twelfth sub-pixels during the seventh to twelfth periods. The first gamma voltage generator 208*b*_1 may be designed to generate a gamma voltage associated with RGB colors.

As described above, the electronic device 100 may be designed such that the plurality of source lines are grouped and operate as one source amplified in the stripe type of second display panel 160*b* and may use an output of the one source amplifier to provide a signal to sub-pixels connected to adjacent other source lines based on a connection switch for selectively connecting output ends of source amplifiers. Thus, the electronic device 100 may enhance power consumption.

Figure 6A:
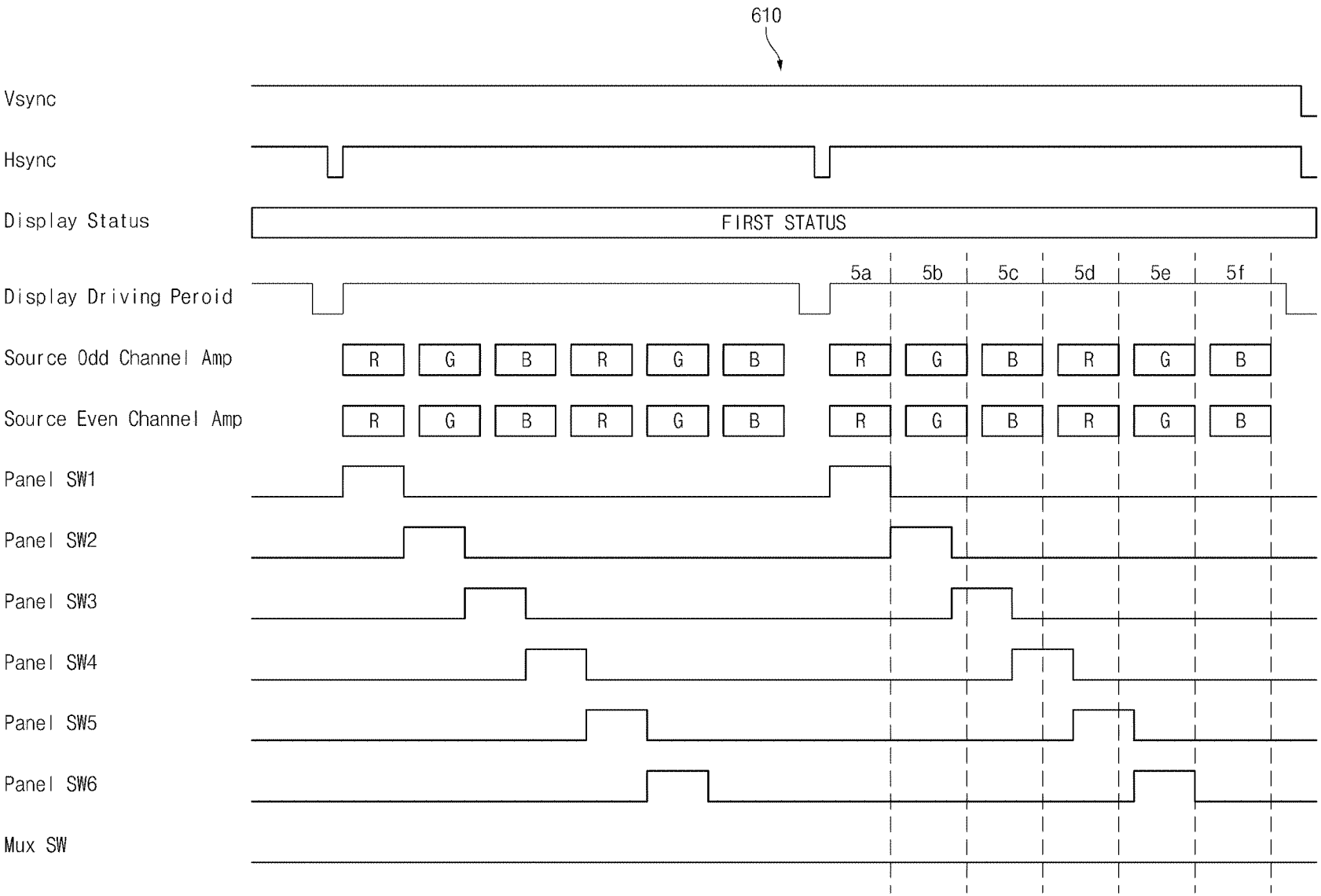
FIGS. 6A and 6B are diagrams of a scheme for driving a stripe layout type of a second display panel, according to an embodiment of the present disclosure.
Figure 6B:
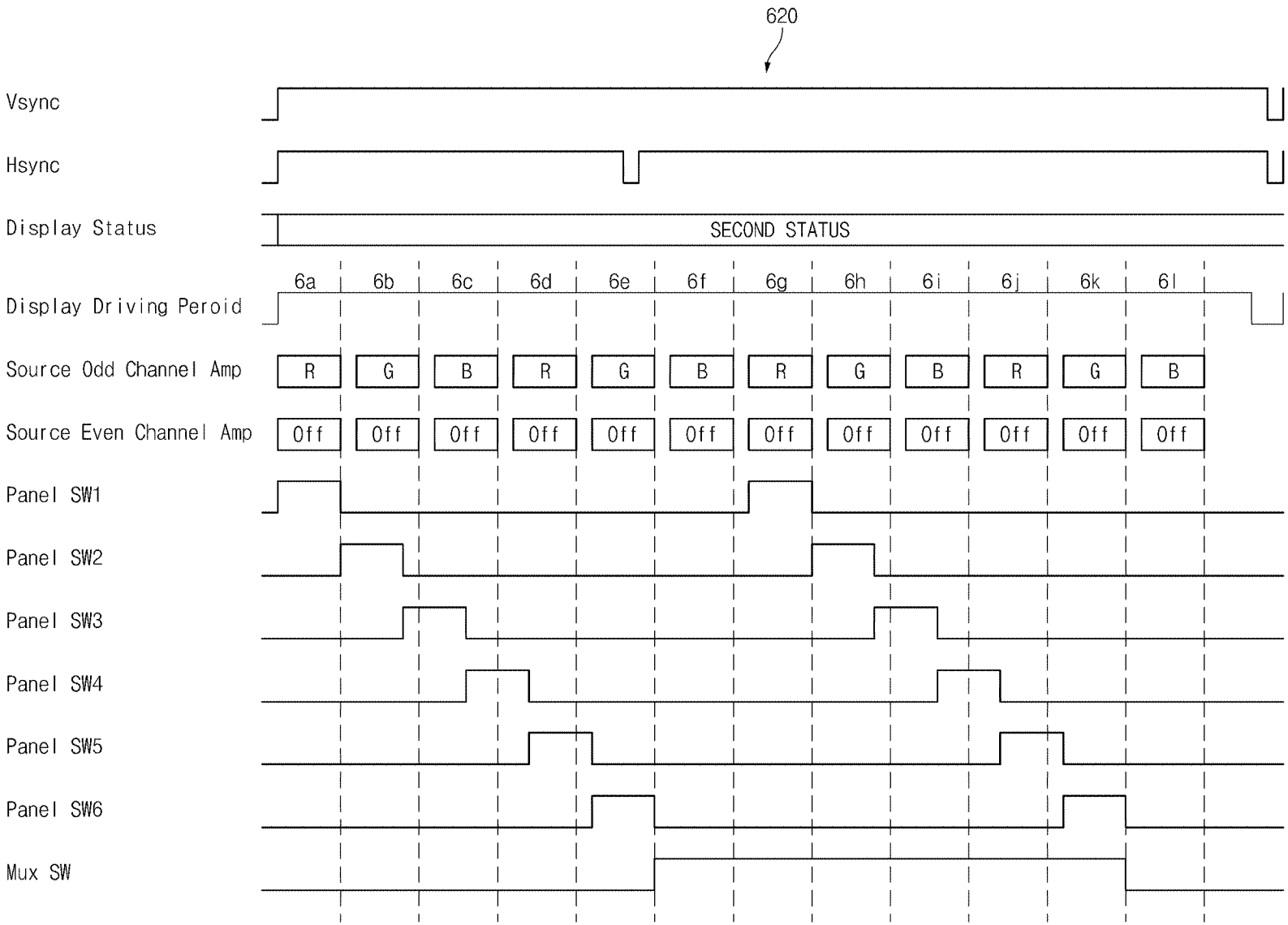

FIGS. 6A and 6B are diagrams of a scheme for driving a stripe layout type of a second display panel, according to an embodiment of the present disclosure.

Referring to FIGS. 5 and 6A and 6B, the second display panel 160*b* may operate in a first status 610 and a second status 620. The first status 610 may include a status for driving the second display panel 160*b* based on a relatively higher driving frequency than the second status 620. A driving frequency of the second display panel 160*b* in the first status 610 may be a first frequency (e.g., 120 Hz, 60 Hz, 45 Hz, or 30 Hz), and a driving frequency of the second display panel 160*b* in the second status 620 may be a second frequency (e.g., 60 Hz when the first frequency is 120 Hz, 30 Hz when the first frequency is 60 Hz, 15 Hz when the first frequency is 30 Hz). The second display panel 160*b* may be changed from the first status 610 to the second status 620 or from the second status 620 to the first status 610, in response to at least one of a user setting, a type of an executed function, or a change in a state of the electronic device 100 of FIG. 1 (e.g., transition to an AOD function in a wake-up state, wake-up state transition in an AOD function state). A synchronous signal of the second display panel 160*b* may include a Vsync and an Hsync. A plurality of horizontal synchronous signals may be located within one Vsync. The number of the plurality of Hsync signals may vary according to a level of a driving frequency of the second display panel 160*b*.

A logic circuit associated with driving the second display panel 160*b* may include a source odd channel amplifier (e.g., a first source amplifier 511) and a source even channel amplifier (e.g., a second source amplifier 512). In connection with driving the second display panel 160*b*, at least one switch may be located in the second display panel 160*b* and a second logic circuit 202*b*. The at least one switch may include the first panel switch 541*a*, which operates based on a first switch control signal PNL_SW1 and is located between an output end of the first source amplifier 511 and a first sub-pixel, the second panel switch 541*b*, which operates based on a second switch control signal PNL_SW2 and is located between the output end of the first source amplifier 511 and a second sub-pixel, the third panel switch 541*c*, which operates based on a third switch control signal PNL_SW3 and is located between the output end of the first source amplifier 511 and a third sub-pixel, the fourth panel switch 541*d*, which operates based on a fourth switch control signal PNL_SW4 and is located between the output end of the first source amplifier 511 and a fourth sub-pixel, the fifth panel switch 541*d*, which operates based on a fifth switch control signal PNL_SW5 and is located between the output end of the first source amplifier 511 and a fifth sub-pixel, and the sixth panel switch 541*d*, which operates based on a sixth switch control signal PNL_SW6 and is located between the output end of the first source amplifier 511 and a sixth sub-pixel.

The seventh panel switch 542*a*, which operates by the first switch control signal PNL_SW1, may be located between a seventh sub-pixel and the second source amplifier 512. The eighth panel switch 542*b*, which operates by the second switch control signal PNL_SW2, may be located between an eighth sub-pixel and the second source amplifier 512. The ninth panel switch 542*c*, which operates by the third switch control signal PNL_SW3, may be located between a ninth sub-pixel and the second source amplifier 512. The tenth panel switch 542*d*, which operates by the fourth switch control signal PNL_SW4, may be located between a tenth sub-pixel and the second source amplifier 512. The eleventh panel switch 542*e*, which operates by the fifth switch control signal PNL_SW5, may be located between an eleventh sub-pixel and the second source amplifier 512. The twelfth panel switch 542*f*, which operates by the sixth switch control signal PNL_SW6, may be located between a twelfth sub-pixel and the second source amplifier 512.

The second display panel 160*b* may have the first status 610 according to the first display configuration and the second status 620 according to the second display configuration.

In a first interval 5*a* in the first state 610, if the first panel switch 541*a* is turned on according to the first panel switch control signal PNL_SW1 and if a first switch 501 connected with the first source amplifier 511 is turned on according to a first switch control signal Sout_SW1, the first source amplifier 511 (e.g., the source odd channel amplifier) may provide an output signal associated with a red sub-pixel to the first sub-pixel. Similarly, in a second interval 5*b* of the first state 610, if the first switch 501 is turned on according to the first switch control signal Sout_SW1 and if the second panel switch 541*b* is turned on according to the second panel switch control signal PNL_SW2, an output signal of the first source amplifier 511, associated with a green sub-pixel, may be provided to the second sub-pixel. In a third interval 5*c* of the first state 610, if the first switch 501 is turned on according to the first switch control signal Sout_SW1 and if the third panel switch 541*c* is turned on according to the third panel switch control signal PNL_SW3, an output signal of the first source amplifier 511, associated with a blue sub-pixel, may be provided to the third sub-pixel. In a fourth interval 5*d* of the first state 610, if the first switch 501 is turned on according to the first switch control signal Sout_SW1 and if the fourth panel switch 541*d* is turned on according to the fourth panel switch control signal PNL_SW4, an output signal of the first source amplifier 511, associated with a red sub-pixel, may be provided to the fourth sub-pixel. In a fifth interval 5*e* of the first state 610, if the first switch 501 is turned on according to the first switch control signal Sout_SW1 and if the fifth panel switch 541*e* is turned on according to the fifth panel switch control signal PNL_SW5, an output signal of the first source amplifier 511, associated with a green sub-pixel, may be provided to the fifth sub-pixel. In a sixth interval 5*f* of the first state 610, if the first switch 501 is turned on according to the first switch control signal Sout_SW1 and if the sixth panel switch 541*f* is turned on according to the sixth panel switch control signal PNL_SW6, an output signal of the first source amplifier 511, associated with a blue sub-pixel, may be provided to the sixth sub-pixel.

In the entire interval of the second status 620, the second source amplifier 512 may have a turn-off state. In first to sixth intervals 6*a* to 6*f* of the second state 620, the first source amplifier 511 may operate to be the same as the first to sixth intervals 6*a* to 6*f* of the above-mentioned first status 610.

In a seventh interval 6*g* of the second status 620, if a connection switch 590 has a turn-on state depending on a connection switch control signal MUX_SW and if a second switch 502 and the seventh panel switch 542*a* connected with the second source amplifier 512 are turned on according to a second switch control signal Sout_SW2 and the first panel switch control signal PNL_SW1, an output signal of the first source amplifier 511 may be provided to the seventh sub-pixel.

In an eighth interval 6*h* of the second status 620, if the connection switch 590 has the turn-on state depending on the connection switch control signal MUX_SW and if the second switch 502 and the eighth panel switch 542*b* connected with the second source amplifier 512 are turned on according to the second switch control signal Sout_SW2 and the second panel switch control signal PNL_SW2, an output signal of the first source amplifier 511 may be provided to the eighth sub-pixel.

In a ninth interval 6*i* of the second status 620, if the connection switch 590 has the turn-on state depending on the connection switch control signal MUX_SW and if the second switch 502 and the ninth panel switch 542*c* connected with the second source amplifier 512 are turned on according to the second switch control signal Sout_SW2 and the third panel switch control signal PNL_SW3, an output signal of the first source amplifier 511 may be provided to the ninth sub-pixel.

In a tenth interval 6*j* of the second status 620, if the connection switch 590 has the turn-on state depending on the connection switch control signal MUX_SW and if the second switch 502 and the tenth panel switch 542*d* connected with the second source amplifier 512 are turned on according to the second switch control signal Sout_SW2 and the fourth panel switch control signal PNL_SW4, an output signal of the first source amplifier 511 may be provided to the tenth sub-pixel.

In an eleventh interval 6*k* of the second status 620, if the connection switch 590 has the turn-on state depending on the connection switch control signal MUX_SW and if the second switch 502 and the eleventh panel switch 542*e* connected with the second source amplifier 512 are turned on according to the second switch control signal Sout_SW2 and the fifth panel switch control signal PNL_SW5, an output signal of the first source amplifier 511 may be provided to the eleventh sub-pixel.

In a twelfth interval 6*l* of the second status 620, if the connection switch 590 has the turn-on state depending on the connection switch control signal MUX_SW and if the second switch 502 and the twelfth panel switch 542*f* connected with the second source amplifier 512 are turned on according to the second switch control signal Sout_SW2 and the sixth panel switch control signal PNL_SW6, an output signal of the first source amplifier 511 may be provided to the twelfth sub-pixel.

Figure 7:
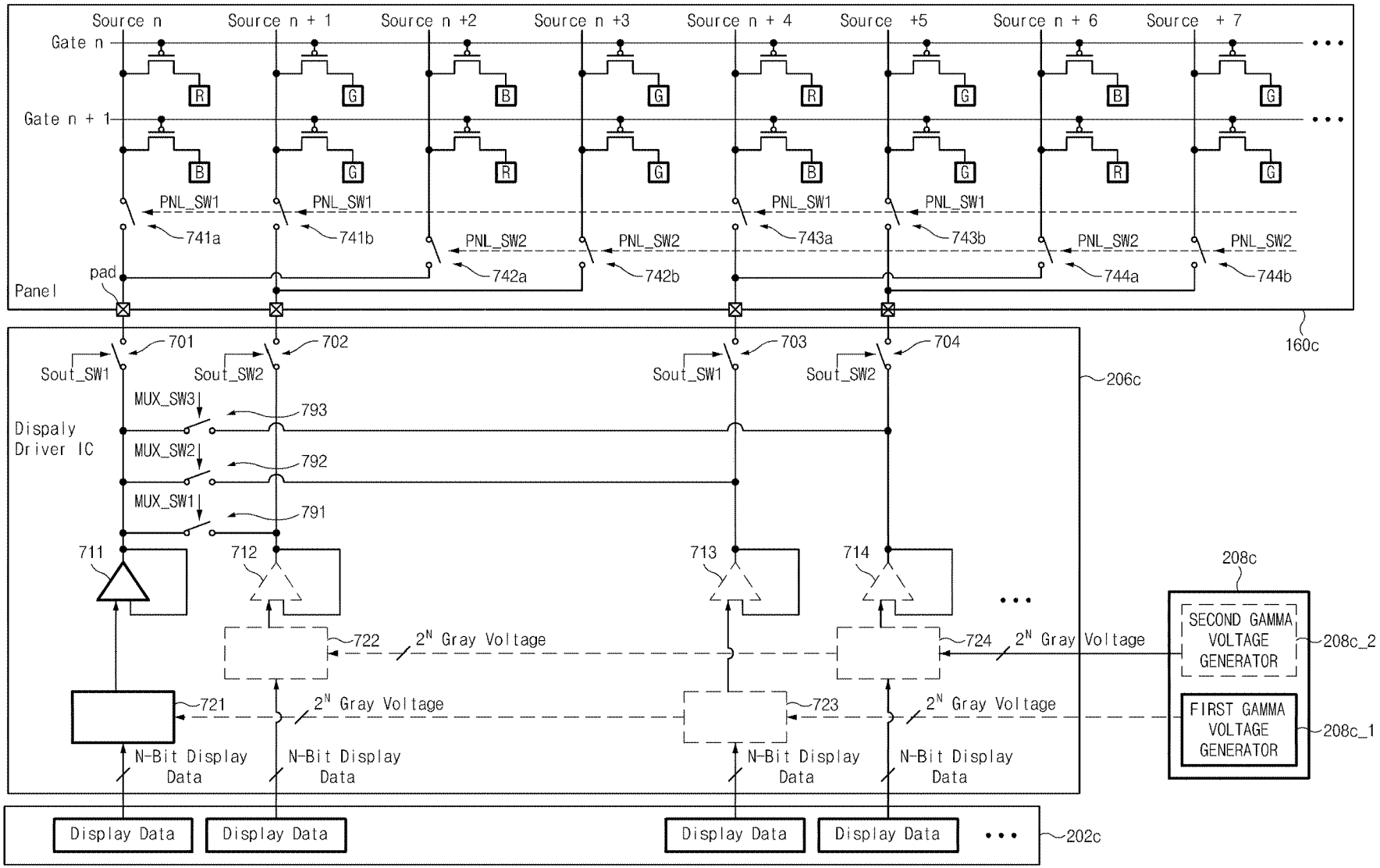
FIG. 7 is a diagram of a PenTile™ display panel, according to an embodiment of the present disclosure.

FIG. 7 is a diagram of a PenTile™ display panel, according to an embodiment of the present disclosure.

Referring to FIG. 7, the electronic device 100 of FIG. 1 may include a PenTile™ type of third display panel 160*c*, a third source driver 206*c*, a third gamma generator 208*c*, and a third logic circuit 202*c*.

The PenTile™ type of third display panel 160*c* may include a display region in which a plurality of gate lines Gates n and n+1 (where n is a natural number) and PenTile™ source lines Sources n to n+7 where four sub-pixels (e.g., RGBG sub-pixels) are repeatedly disposed to intersect each other. The third display panel 160*c* may include a non-display region where the third source driver 206*c*, which provides display data to the gate lines Gates n and n+1 and the PenTile™ source lines Sources n to n+7, and a gate driver 207 which provides a gate signal to the gate lines Gates n and n+1 and the PenTile™ source lines Sources n to n+7 are mounted. Alternatively, the DDI 200 may be located in the non-display region of the third display panel 160*c*.

Panel switches 741*a*, 741*b*, 742*a*, 742*b*, 743*a*, 743*b*, 744*a*, and 744*b* for switching outputs of source amplifiers to the sub-pixels may be located in an outer portion of the display region of the third display panel 160*c*. The panel switches 741*a*, 741*b*, 742*a*, 742*b*, 743*a*, 743*b*, 744*a*, and 744*b* may be driven by the first panel switch control signal PNL_SW1 and the second panel switch control signal PNL_SW2). The first panel switch 741*a*, the second panel switch 741*b*, the fifth panel switch 743*a*, and the sixth panel switch 743*b* may operate by the first panel switch control signal PNL_SW1. The third panel switch 742*a*, the fourth panel switch panel switch 742*b*, the seventh panel switch 744*a*, and the eighth panel switch 744*b* may operate by the second panel switch control signal PNL_SW2.

The electronic device 100 (or the DDI 200) may further include first to fourth source amplifiers 711 to 714. The third source amplifier 713 and the fourth source amplifier 714 may be connected with sub-pixels (e.g., a red sub-pixel and a blue sub-pixel or a first green sub-pixel and a second green sub-pixel) similarly grouped to the first source amplifier 711 and the second source amplifier 712. The first to fourth source amplifiers 711 to 714 may be electrically connected with grouped sub-pixels through panel switches.

A gate signal may be sequentially provided to the gate lines Gates n and n+1. Alternatively, the gate lines Gates n and n+1 may be classified into an odd line and an event line. The PenTile™ source lines Sources n to n+7 may be located to intersect the gate lines Gates n and n+1. Sub-pixels may be located on each of the PenTile™ source lines Sources n to n_7. First to eighth sub-pixels (e.g., RGBGRGBG sub-pixels) may be located on the PenTile™ source lines Sources n to n_7 intersecting the first gate line Gate n.

The third source driver 206*c* may include the first source amplifier 711 for providing a signal to a first group channel (including PenTile™ source lines Sources n and n+2) among the PenTile™ source lines Sources n to n_7, the second source amplifier 712 for providing a signal to a second group channel (including PenTile™ source lines Sources n+1 and n+3) among the PenTile™ source lines Sources n to n_7, the third source amplifier 713 for providing a signal to a third group channel (including PenTile™ source lines Sources n+4 and n+6) among the PenTile™ source lines Sources n to n_7, and the fourth source amplifier 714 for providing a signal to a fourth group channel (including PenTile™ source lines Sources n+5 and n+7) among the PenTile™ source lines Sources n to n_7.

The third source driver 206*a* may include a first switch 701 which is connected to an output end of the first source amplifier 711 and operates by a first switch control signal Sout_SW1, a second switch 702 which is connected to an output end of the second source amplifier 712 and operates by a second switch control signal Sout_SW2, a third switch 703 which is connected to an output end of the third source amplifier 713 and operates by the first switch control signal Sout_SW1, and a fourth switch 704 which is connected to an output end of the fourth source amplifier 714 and operates by the second switch control signal Sout_SW2.

The third source driver 206*c* may include a first connection switch 791 which is located between the output end of the first source amplifier 711 and the output end of the second source amplifier 712 and operates by a first connection switch control signal MUX_SW1, a second connection switch 792 which is located between the output end of the first source amplifier 711 and the output end of the third source amplifier 713 and operates by a second connection switch control signal MUX_SW2, and a third connection switch 793 which is located between the output end of the first source amplifier 711 and the output end of the fourth source amplifier 714 and operates by a third connection switch control signal MUX_SW3.

A control signal of each switch may be provided from a timing controller which receives a control signal of the processor 140 of FIG. 1. The third source driver 206*a* may include a first decoder 721 located at an input end of the first source amplifier 711, a second decoder 722 located at an input end of the second source amplifier 712, a third decoder 723 located at an input end of the third source amplifier 713, and a fourth decoder 724 located at an input end of the fourth source amplifier 714.

The first to fourth decoders 721 to 724 may receive display data and a digital gamma value from the third logic circuit 202*c*. Further, the first to fourth decoders 721 to 724 may receive an output of the third gamma generator 208*c*.

The third gamma generator 208*c* may include a first gamma voltage generator 208*c*_1 and a second gamma voltage generator 208*c*_2. The first gamma voltage generator 208*c*_1 may generate an analog gamma value associated with a color of a first sub-pixel (e.g., a red sub-pixel) connected to the output end of the first source amplifier 711, and may provide the generated analog gamma value to the first decoder 721 in a first period. The first gamma voltage generator 208*c*_1 may generate an analog gamma value associated with a color of a third sub-pixel (e.g., a blue sub-pixel) connected to the output end of the first source amplifier 711, and may provide the generated analog gamma value to the first decoder 721 in a third period. The first gamma voltage generator 208*c*_1 may generate an analog gamma value associated with a color of a fifth sub-pixel (e.g., a red sub-pixel) connected to the output end of the second source amplifier 712, and may provide the generated analog gamma value to the third decoder 723 in a fifth period. The first gamma voltage generator 208*c*_1 may generate an analog gamma value associated with a color of a seventh sub-pixel (e.g., a blue sub-pixel) connected to the output end of the second source amplifier 712, and may provide the generated analog gamma value to the third decoder 723 in a seventh period.

The second gamma voltage generator 208*c*_2 may generate an analog gamma value associated with a color of a second sub-pixel and a fourth sub-pixel (e.g., green sub-pixels) connected to the output end of the first source amplifier 711, and may provide the generated analog gamma value to the second decoder 722 during a second period and a fourth period. The second gamma voltage generator 208*c*_2 may generate an analog gamma value associated with a color of the second sub-pixel and the fourth sub-pixel (e.g., the green sub-pixels) connected to the output end of the second source amplifier 712, and may provide the generated analog gamma value to the fourth decoder 724 during a sixth period and an eighth period.

The first gamma voltage generator 208_1 may generate a gamma voltage associated with the first sub-pixel and the third sub-pixel or the fifth sub-pixel and the seventh sub-pixel (or odd-numbered sub-pixels), and may supply the generated gamma voltage to the first decoder 721 and the third decoder 723 (or odd-numbered sub-pixels) in a first display configuration state in connection with driving the third display panel 160*c*. The first gamma voltage generator 208*c*_1 may generate a gamma voltage associated with each of the first to eighth sub-pixels and may supply the generated gamma voltage to the first decoder 721 (or a 2n+1th sub-pixel, where n is an integer greater than or equal to 0) in a second display configuration state. The first gamma voltage generator 208*c*_1 may be provided to generate a red, green1, blue, green2 (RGBG) gamma voltage.

The third logic circuit 202*c* may provide display data to each of the PenTile™ source lines Sources n to n+7 through the first to fourth decoders 721 to 724 located for each group channel. The third logic circuit 202*c* may provide display data to a first red sub-pixel through the first decoder 721 during the first period, and may provide display data to a first green sub-pixel through the second decoder 722 during the second period. The third logic circuit 202*c* may provide display data to a first blue sub-pixel through the first decoder 721 during the third period and may provide display data to a second green sub-pixel through the second decoder 722 during the fourth period. During fifth to eighth periods, the third logic circuit 202*c* may provide display data to the third decoder 723 and the fourth decoder 724 associated with other RGBG sub-pixels adjacent to RGBG sub-pixels for providing display data during the first to fourth periods.

According to the first display configuration (e.g., a configuration for driving the third display panel 160*c* based on a relatively high driving frequency), the first decoder 721 and the third decoder 722 may provide a signal decoded during the first to fourth periods to the first source amplifier 711 and the second source amplifier 712 in the manner described above with reference to FIG. 3. The first source amplifier 711 and the second source amplifier 712 may provide a signal to each of a red sub-pixel, a first green red sub-pixel, a blue red sub-pixel, and a second green red sub-pixel in the manner described above with reference to FIG. 3. The third decoder 723 and the fourth decoder 724 may alternately provide a signal decoded during the fifth to eighth periods to the third source amplifier 713 and the fourth source amplifier 714. The third decoder 723 and the fourth decoder 724 may alternately provide a signal to other sub-pixels (e.g., a red sub-pixel, a first green sub-pixel, a blue sub-pixel, and a second green sub-pixel) adjacent to RGBG sub-pixels which are lit during the first to fourth periods.

According to the second display configuration (e.g., a configuration for driving the third display panel 160*c* based on a relatively lower driving frequency than the first display configuration), the second source amplifier 712, the third source amplifier 713, and the fourth source amplifier 714 may be turned off. The first connection switch 791, the second connection switch 792, and the third connection switch 793 may be turned on sequentially or while the second display configuration is maintained. The first gamma voltage generator 208*c*_1 may generate a gamma voltage associated with respective sub-pixels (e.g., RGBG sub-pixels) and may supply the generated gamma voltage to the first decoder 721. The second gamma voltage generator 208*c*_2 may be deactivated. The second to fourth decoders 722 to 724 may be deactivated.

The first decoder 721 may receive display data to be provided to eight sub-pixels from the third logic circuit 202*c* during the first to eighth periods (e.g., eight consecutive Hsync periods), and may receive a gamma voltage associated with driving the eight sub-pixels from the first gamma voltage generator 208*c*_1. The first decoder 721 may provide signals decoded based on the received display data and the received gamma voltages to the first source amplifier 711.

The first source amplifier 711 may be divided and driven in a time-sliced manner and may provide an output signal to each of the eight sub-pixels. An output signal of the first source amplifier 711 may be provided to the first green sub-pixel and the second green sub-pixel in a state where the first connection switch 791 is turned on. Similarly, an output signal of the first source amplifier 711 may be provided to the red sub-pixel and the blue sub-pixel connected to the third source amplifier 713 in a state where the second connection switch 792 is turned on. An output signal of the first source amplifier 711 may be provided to the first green sub-pixel and the second green sub-pixel connected to the fourth source amplifier 714 in a state where the third connection switch 793 is turned on. In connection with providing the output signal of the first source amplifier 711, the first to eighth panel switches 741*a*, 741*b*, 742*a*, 742*b*, 743*a*, 743*b*, 744*a*, and 744*b* may sequentially have a turn-on state.

In the above description, the eight PenTile™ source lines and the two gate lines are located in the third display panel 160*c*; however, the present disclosure is not limited. For example, the PenTile™ source lines and the gate lines may be further increased according to resolution of the third display panel 160*c*. As the PenTile™ source lines are increased, source amplifiers for providing source signals to group channels (e.g., a red-blue group channel and a green1-green2 group channel) and decoders may be also increased. In the above description, the third source driver 206*c* uses an output of one source amplifier for other source lines after the four source amplifiers are connected through the connection switches; however, the present disclosure is not limited thereto. For example, there can be four or more source amplifiers (e.g., five source amplifiers, six source amplifiers) connected with the output end of the first source amplifier 711.

As described above, the electronic device 100 may operate one source amplifier for driving a plurality of pixels (e.g., two pixels configured with eight sub-pixels) depending on the second display configuration to remove power consumption consumed to drive the other source amplifiers (e.g., the second to fourth source amplifiers), thus enhancing power consumption of the electronic device 100.

Figure 8:
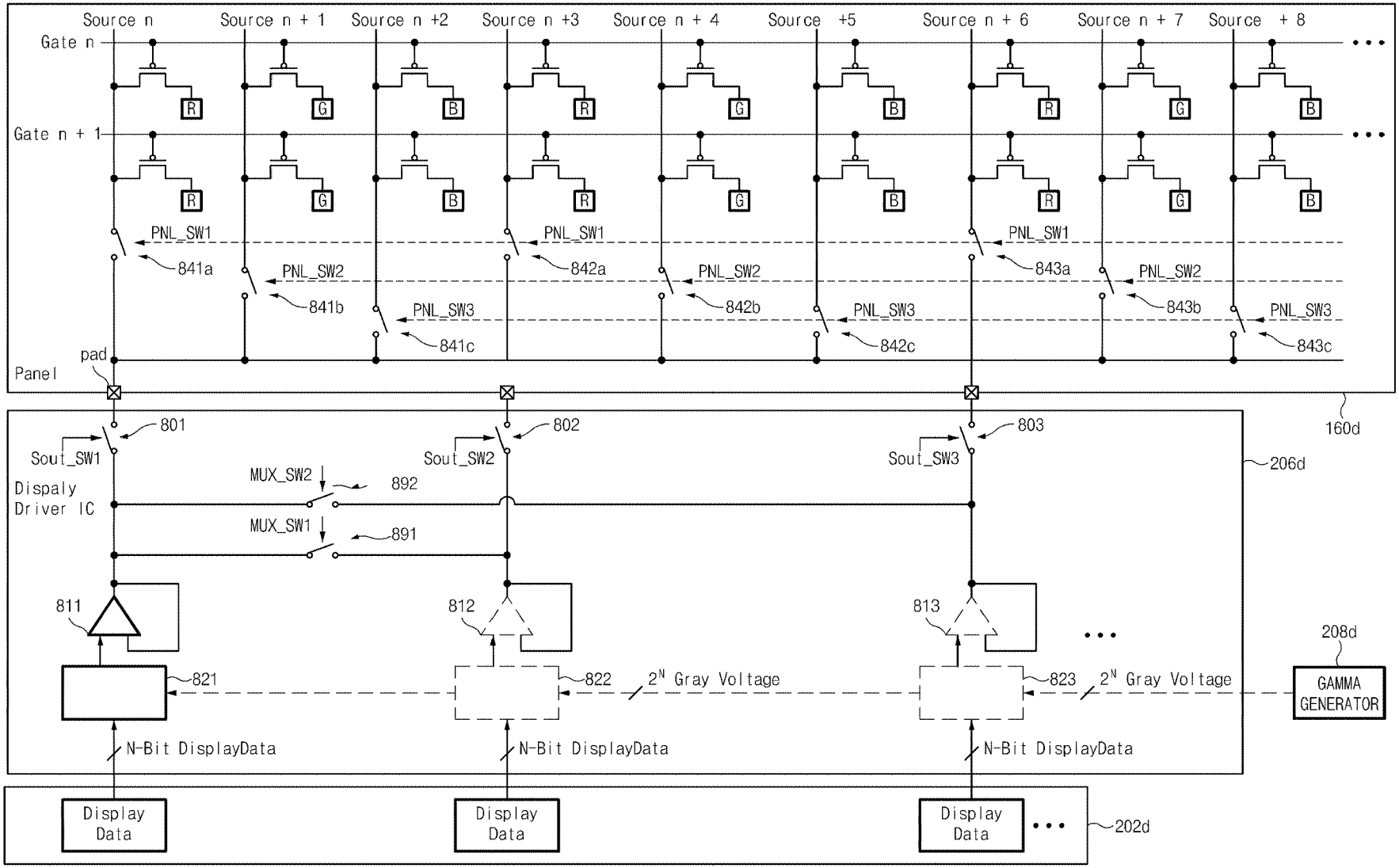
FIG. 8 is a diagram of a stripe layout type of a second display panel, according to an embodiment of the present disclosure.

FIG. 8 is a diagram of a stripe layout type of a second display panel, according to an embodiment of the present disclosure.

Referring to FIG. 8, the electronic device 100 of FIG. 1 may include a stripe layout type of fourth display panel 160*d*, a fourth source driver 206*d*, a fourth gamma generator 208*d*, and a fourth logic circuit 202*d*.

The stripe layout type of fourth display panel 160*d* may include a display region in which a plurality of gate lines Gates n and n+1 and a plurality of stripe source lines Sources n to n+8 intersect each other. The fourth display panel 160*d* may include a non-display region where the fourth source driver 206*d*, which provides display data to the gate lines Gates n and n+1, and the stripe source lines Sources n to n+8 and a gate driver 207, which provides a gate signal to the gate lines Gates n and n+1, and the stripe source lines Sources n to n+8 are mounted. A pixel in the stripe layout type of fourth display panel 160*d* may include a form in which RGB sub-pixels are grouped.

A gate signal may be sequentially provided to the gate lines Gates n and n+1. Alternatively, the gate lines Gates n and n+1 may include an odd gate line Gate and an even gate line Gate n+1. A gate signal may be alternately provided to the odd gate line Gate and the even gate line Gate n+1. RGB sub-pixels may form one pixel and may be repeatedly located on the odd gate line Gate n.

Red sub-pixels, green sub-pixels, or blue sub-pixels may be located on each of the stripe source lines Sources n to n+8. Pads connected with output ends of source amplifiers of the fourth source driver 206*d* may be located at one side of the fourth display panel 160*d* at ends of some of the stripe source lines Sources n to n+8 (or at ends of some channels if the stripe source lines Sources n to n+8 are represented as channels). A plurality of panel switches may be located between the stripe source lines Sources n to n+8 and the pads. In connection with grouped pixels (or three sub-pixels), the panel switches may include a first panel switch 841*a*, which is located between the first source line Source n and the pad and is driven by a first panel switch control signal PNL_SW1, a second panel switch 841*b*, which is located between the second source line Source n+1 and the pad and is driven by a second panel switch control signal PNL_SW2, a third panel switch 841*c*, which is located between the third source line Source n+2 and the pad and is driven by a third panel switch control signal PNL_SW3, a fourth panel switch 842*a*, which is located between the fourth source line Source n+3 and the pad and is driven by the first panel switch control signal PNL_SW1, a fifth panel switch 842*b*, which is located between the fifth source line Source n+4 and the pad and is driven by the second panel switch control signal PNL_SW2, a sixth panel switch 842*c*, which is located between the sixth source line Source n+5 and the pad and is driven by the third panel switch control signal PNL_SW3, a seventh panel switch 843*a*, which is located between the seventh source line Source n+6 and the pad and is driven by the first panel switch control signal PNL_SW1, an eighth panel switch 843*b*, which is located between the eight source line Source n+7 and the pad and is driven by the second panel switch control signal PNL_SW2, and a ninth panel switch 843*c*, which is located between the ninth source line Source n+8 and the pad and is driven by the third panel switch control signal PNL_SW3.

The first to third panel switches 841*a* to 841*c* may be connected to an output end of a first source amplifier 811 via a first switch 801, which is driven based on a first switch control signal Sout_SW1. The fourth to sixth panel switches 842*a* to 842*c* may be connected to an output end of a second source amplifier 812 via a second switch 802, which is driven based on a second switch control signal Sout_SW2. The seventh to ninth panel switches 843*a* to 843*c* may be connected to an output end of a third source amplifier 813 via a third switch 803, which is driven based on a third switch control signal Sout_SW3.

The first panel switch 841*a*, the fourth panel switch 842*a*, and the seventh panel switch 843*a* may be turned on or off by the first panel switch control signal PNL_SW1). Similarly, the second panel switch 841*b*, the fifth panel switch 842*b*, and the eighth panel switch 843*b* may be turned on or off by the second panel switch control signal PNL_SW2). The third panel switch 841*c*, the sixth panel switch 842*c*, and the ninth panel switch 843*c* may be turned on or off by the third panel switch control signal PNL_SW2).

The fourth source driver 206*d* may include the first source amplifier 811 for selectively providing a signal to some of the stripe source lines Sources n to n+8, a first group channel (including the stripe source lines Source n to Source n+2), the second source amplifier 812 for selectively providing a signal to a second group channel (including the stripe source lines Source n+3 to n+5), and the third source amplifier 813 for selectively providing a signal to a third group channel (including the stripe source lines Source n+6 to n+8).

As described above, the fourth source driver 206*d* may include a plurality of source amplifiers for selectively providing a signal to three sub-pixels. If more source lines are located in the fourth display panel 160*d*, the fourth source driver 206*d* may further include source amplifiers for selectively providing a signal to three sub-pixels in response to the source lines. For example, if there are 24 source lines, the fourth source driver 206*d* may include 8 source amplifiers. If there are 3072 source lines, the fourth source driver 206*d* may include 1024 source amplifiers.

The fourth source driver 206*d* may include the first switch 801 connected to the output end of the first source amplifier 811, the second switch 802 connected to the output end of the second source amplifier 812, and the third switch 803 connected to the output end of the third source amplifier 812.

The fourth source driver 206*d* may include a first connection switch 891 which is connected between the output end of the first source amplifier 811 and the output end of the second source amplifier 812 and is driven by a first connection switch control signal MUX_SW1, and a second connection switch 892 which is connected between the output end of the first source amplifier 811 and the output end of the third source amplifier 813 and is driven by a second connection switch control signal MUX_SW2. A connection switch connected to the output end of the first source amplifier 811 may be added according to a design. For example, in a display panel where a plurality of source amplifiers are located, there may be "m" or more (where "m" is a natural number) source amplifiers connected with the first source amplifier 811 through connection switches, and the number of connection switches may be "m" or more as the source amplifiers are increased.

A control signal of each of the above-mentioned switches may be provided from a timing controller which receives a control signal of the processor 140 of FIG. 1. The fourth source driver 206*d* may include a first decoder 821 located at an input end of the first source amplifier 811, a second decoder 822 located at an input end of the second source amplifier 812, and a third decoder 823 located at an input end of the third source amplifier 813. The first to third decoders 821 to 823 may receive display data from the fourth logic circuit 202*d*. The first to third decoders 821 to 823 may receive a gamma voltage corresponding to respective sub-pixels from the fourth gamma generator 208*d*.

The fourth gamma generator 208*d* may generate analog gamma values associated with colors of first to ninth sub-pixels (e.g., RGBRGBRGB sub-pixels) and may provide the generated analog gamma values to the first to third decoders 821 to 823. As sub-pixels are increased, the fourth gamma generator 208*d* may generate a gamma voltage associated with the increased sub-pixels and may supply the generated gamma voltage to a decoder connected to the sub-pixel.

The fourth logic circuit 202*d* may provide display data to each of the stripe source lines Sources n to n+8 through the first to third decoders 821 to 823, respectively, located for the first to third source amplifiers 811 to 813. When the fourth display panel 160*d* is driven according to a first display configuration (e.g., a display configuration according to operation of a relatively higher driving frequency), during a first period (e.g., one Hsync period) among a plurality of periods associated with driving the fourth display panel 160*d*, the fourth logic circuit 202*d* may provide display data of the first sub-pixel (e.g., a red sub-pixel) located on a specified gate line in the first source line Source n to the first decoder 821.

The fourth gamma generator 208*d* may generate a gamma voltage associated with the first sub-pixel and may supply the generated gamma voltage to the first decoder 821. The first decoder 821 may decode the provided display data and the supplied gamma voltage and may provide the decoded signal to the first source amplifier 811. The first source amplifier 811 may amplify the received signal and may provide the amplified signal to the first sub-pixel. The fourth logic circuit 202*d* may turn on the first panel switch 841*a* and the first switch 801.

During a second period subsequent to the first period, an output of the first source amplifier 811 may be provided to the second sub-pixel located on the second source line Source n+1. During a third period subsequent to the second period, an output of the first source amplifier 811 may be provided to the third sub-pixel located on the third source line Source n+2. The second panel switch 841*b* and the third panel switch 841*c* may be sequentially turned on, and the first source amplifier 811 may provide an output signal in a time-sliced manner over a time when the panel switch is turned on.

During subsequent fourth to sixth periods, an output of the second source amplifier 812 may be sequentially provided to the fourth sub-pixel located on the fourth source line Source n+3, the fifth sub-pixel located on the fifth source line Source n+4, and the sixth sub-pixel located on the sixth source line Source n+5. The fourth to sixth panel switch 842*a* to 842*c* may be sequentially turned on, and the second source amplifier 812 may provide an output signal in a time-sliced manner over a time when the panel switch is turned on.

During subsequent seventh to ninth periods, an output of the third source amplifier 813 may be sequentially provided to the seventh sub-pixel located on the seventh source line Source n+6, the eighth sub-pixel located on the eighth source line Source n+7, and the ninth sub-pixel located on the ninth source line Source n+8. The seventh to ninth panel switch 843*a* to 843*c* may be sequentially turned on, and the third source amplifier 813 may provide an output signal in a time-sliced manner over a time when the panel switch is turned on.

When the fourth display panel 160*d* is driven according to the second display configuration (e.g., a configuration for driving the fourth display panel 160*d* at a relatively lower driving frequency than the first display configuration), the fourth display 160*d* may operate to be the same as the first to third periods described above in the display configuration during the first to third periods among a plurality of Hsync periods. The fourth logic circuit 202*d* may turn off the second source amplifier 812 and the third source amplifier 813 during a second display configuration period. While the fourth display panel 160*d* is driven according to the second display configuration, the fourth logic circuit 202*d* may drive an $n^{th}$ source amplifier (n is a natural number) in a time-sliced manner and may turn off an n+1th source amplifier and an n+2 source amplifier.

In the sixth period subsequent to the fifth period, the fourth logic circuit 202*d* may turn on the first connection switch 891 connected between the output end of the first source amplifier 811 and the output end of the second source amplifier 812. The fourth logic circuit 202*d* may block the supply of power to the second source amplifier 812 and the second decoder 822 and may drive the fourth to ninth sub-pixels using the first source amplifier 811 and the first decoder 821. The fourth gamma generator 208*d* may generate a gamma voltage associated with the first to third sub-pixels during the first to third periods and may generate a gamma voltage associated with the fourth to ninth sub-pixels during the fourth to ninth periods. The fourth gamma generator 208*d* may be designed to generate a gamma voltage associated with red, green, blue colors.

As described with reference to FIGS. 3 and 8, the electronic device 100 may include a plurality of source amplifiers in a display panel. The electronic device 100 may deactivate some source amplifiers depending on display configuration in a state where a plurality of source lines are assigned to each of the plurality of source amplifiers, and where a connection switch is located between the source amplifiers, and may drive a source line based on an output of a specified source amplifier. In a case of an RGB stripe type, the number of source lines connected to the one source amplifier is 3× (x is a natural number). In a case of a PenTile™ type, the number of source lines connected to the one source amplifier is 2n+2 (n is an odd number of greater than or equal to "0").

According to various embodiments, a display driver integrated circuit (DDI) includes a plurality of source amplifiers and a switch (e.g., a connection switch) configured to connect output ends of some of the plurality of source amplifiers with each other and may include a logic circuit configured to provide a source signal to a plurality of source lines (or a plurality of source line groups or a plurality of grouped source lines) in a time-sliced manner. The logic circuit may be configured to provide a source signal to the plurality of source lines selectively connected to other source amplifiers adjacent to a specified source amplifier using an output of the specified source amplifier.

According to various embodiments, an electronic device includes a display panel configured to include a plurality of source line groups selectively connected with a plurality of source amplifiers and panel switches located between the plurality of source line groups and the plurality of source amplifiers and a display driver integrated circuit (DDI) configured to drive the display panel, wherein the DDI includes the plurality of source amplifiers, decoders respectively connected to the plurality of source amplifiers, a logic circuit configured to provide display data to the decoders, a gamma generator configured to supply a gamma voltage to the decoders, and at least one switch configured to selectively connect the plurality of source amplifiers with the plurality of source line groups.

The logic circuit may be configured to turn off some of the plurality of amplifiers depending on a driving frequency of the display panel and drive the plurality of source lines based on a specified source amplifier.

The logic circuit may be configured to deactivate decoders assigned to the turned-off some source amplifiers.

The logic circuit may be configured to drive the specified source amplifier in a time-sliced manner to provide a specified source signal to the plurality of source line groups.

The display panel may include a plurality of pixels, each including a stripe type of red, green, blue (RGB) sub-pixels, and wherein each of the plurality of source amplifiers is selectively connected with 3n (n is a natural number) sub-pixels.

The logic circuit may be configured to operate the gamma generator in a time-sliced manner to generate at least one gamma voltage corresponding to a red sub-pixel, a green sub-pixel, and a blue sub-pixel and supply the at least one generated gamma voltage to the decoders.

The display panel comprises a plurality of pixels, each including a PenTile™ type of red, green1, blue, green2 (RGBG) sub-pixels, and wherein each of the plurality of source amplifiers is selectively connected with 2m+2 (m is 0 and an odd number) sub-pixels.

The logic circuit may be configured to operate the gamma generator in a time-sliced manner to generate a gamma voltage corresponding to at least one of a red sub-pixel, a first green sub-pixel, a blue sub-pixel, and a second green sub-pixel and supply the generated gamma voltage to the decoders.

The display panel may include a plurality of pixels, each including a PenTile™ type of RGBG sub-pixels, and wherein the plurality of source amplifiers may include a first source amplifier located to output a source signal to a red sub-pixel and a blue sub-pixel with respect to each of the plurality of pixels and a second source amplifier located to output a source signal to a first green sub-pixel and a second green sub-pixel with respect to each of the plurality of pixels.

The gamma generator may include a first gamma voltage generator configured to generate and supply a gamma voltage corresponding to the red sub-pixel and the blue sub-pixel to a decoder connected to the first source amplifier and a second gamma voltage generator configured to generate and supply a gamma voltage corresponding to the first green sub-pixel and the second green sub-pixel to a decoder connected to the second source amplifier.

The logic circuit may be configured to turn off the at least one switch, while the display panel is driven at a first driving frequency, and turn on the at least one switch while the display panel is driven at a second driving frequency relatively lower than the first driving frequency to provide an output of the first source amplifier to the first green sub-pixel and the second green sub-pixel which are connected to the second source amplifier.

The logic circuit may be configured to control the first gamma voltage generator to generate a gamma voltage associated with the red sub-pixel and a gamma voltage associated with the blue sub-pixel while the display panel is driven at a first driving frequency and control the second gamma voltage generator to generate a gamma voltage associated with the red sub-pixel, a gamma voltage associated with the first green sub-pixel, a gamma voltage associated with the blue sub-pixel, and a gamma voltage associated with the second green sub-pixel while the display panel is driven at a second driving frequency relatively lower than the first driving frequency.

The at least one switch may include a plurality of switches configured to selectively connect a specified source amplifier and source amplifiers adjacent to the specified source amplifier.

Figure 9:
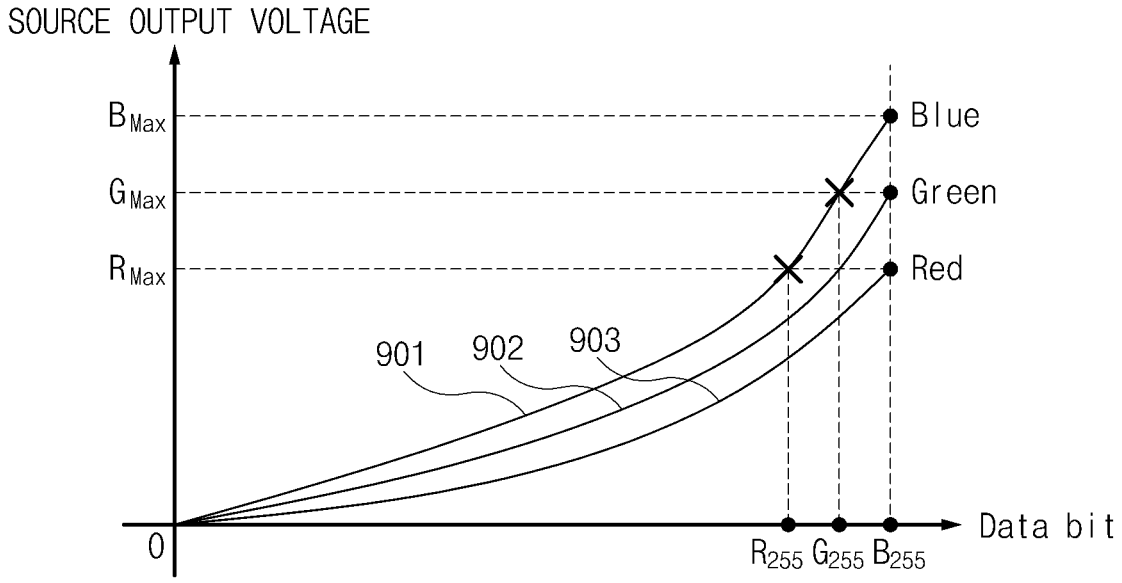
FIG. 9 is a waveform chart of an output of a digital gamma value, according to an embodiment of the present disclosure.

FIG. 9 is a diagram of an output of a digital gamma value, according to an embodiment of the present disclosure.

Referring to FIG. 9, a gamma value curve for each color may be represented as the graphs 901 to 903, which may indicate gamma value curves associated with respective colors. The first graph 901 may indicate a gamma value curve associated with a blue color. The second graph 902 may indicate a gamma value curve associated with a green color. The third graph 903 may indicate a gamma value curve associated with a red color. A right end of the first graph 901 may indicate a 255 gray level of the color. A form or order of the graphs may vary according to a physical characteristic of sub-pixels applied to the display panel 160 of FIG. 1. For example, a blue source output voltage can represent the highest voltage; however, the present disclosure is not so limited. For example, a red-related graph may be located on the top according to a composition of sub-pixels.

The processor 140 of the electronic device 100 of FIG. 1 may control one gamma generator (e.g., a first gamma voltage generator or a second gamma voltage generator) to generate an analog gamma value according to a gamma value curve and may deactivate the other gamma generator (e.g., the second gamma voltage generator or the first gamma voltage generator). The processor 140 may calculate red and green digital gamma values using a blue gamma value curve. The processor 140 may set a blue gamma value corresponding to a source output voltage $G_{Max}$ to a green maximum gray scale (e.g., $G_{255}$) and may classify the blue gamma curve into 255 gray scales from "0" to a $G_{255}$ point, thus calculating a digital gamma value associated with the green color. The processor 140 may minimize gamma value distortion using 0 to 254 gray levels without using a $G_{255}$ value corresponding to $G_{Max}$. The processor 140 may specify the blue gamma value corresponding to $G_{Max}$ as a red maximum gray scale (e.g., $R_{255}$) and may classify the blue gamma curve into 255 gray scales from "0" to an $R_{255}$ point, thus calculating a digital gamma value associated with the red color. The processor 140 may equally (or non-equally) divide a vertical axis into 255 spaces from "0" to $R_{Max}$ or "0" to $G_{Max}$ and may map a gray level for divided each space.

Figure 10:
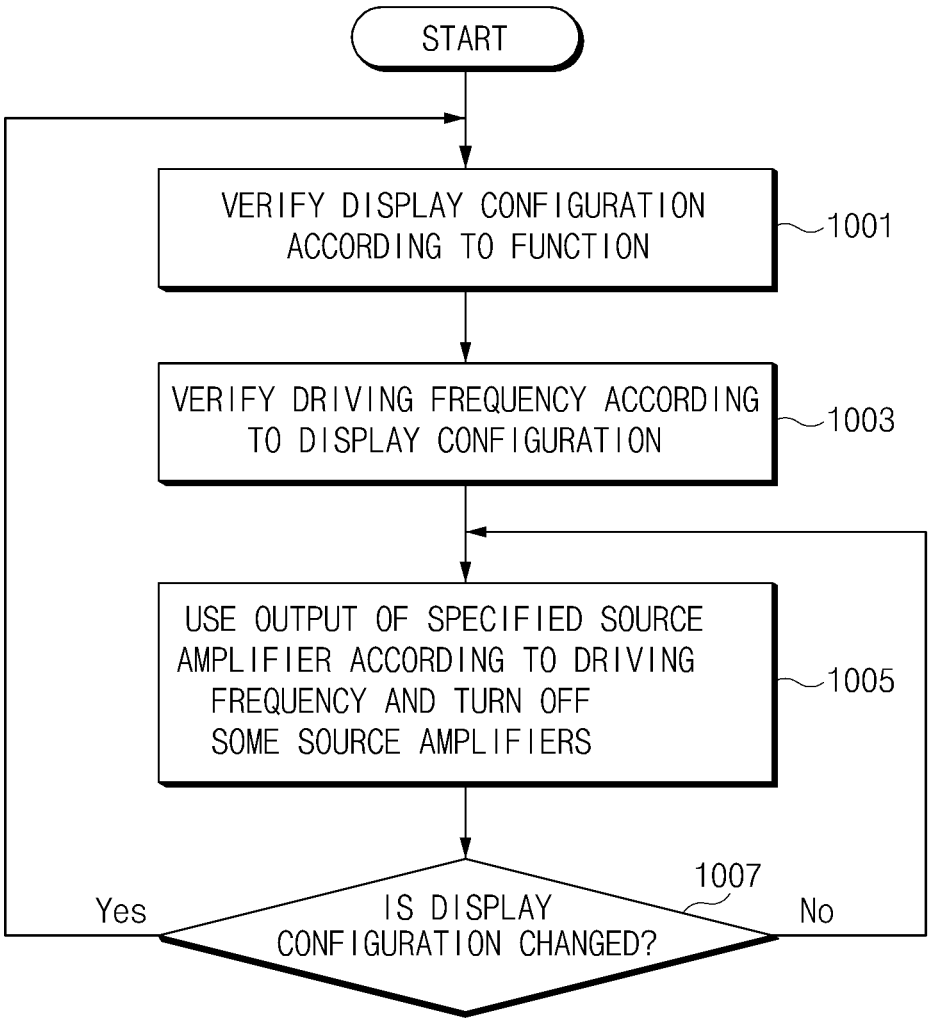
FIG. 10 is a flowchart of a display driving method according to display configuration, according to an embodiment of the present disclosure.

FIG. 10 is a flowchart of a display driving method according to a display configuration, according to an embodiment of the present disclosure.

Referring to FIG. 10, in connection with the display driving method, in step 1001, the processor 140 (or a DDI or a logic circuit) of the electronic device 100 of FIG. 1 may verify the display configuration according to a function. For example, the processor 140 may verify whether there is a display configuration in connection with a function which is currently being executed. If there is no separate display configuration, the processor 140 may drive a display panel according to a default value. The processor 140 may drive each source amplifier in a time-sliced manner based on a turned-off connection switch and may provide an output of each source amplifier to sub-pixels.

In step 1003, the processor 140 may verify a driving frequency according to the display configuration. The processor 140 may verify a driving frequency value set in connection with screen display according to the execution of the function. The electronic device 100 may store and manage a driving frequency mapping table according to the execution of the function or may obtain a driving frequency value from the function. If using the mapping table, the electronic device 100 may verify the mapping table to verify the driving frequency value when a specific function is executed or when a function of the electronic device 100 is changed (e.g., when a lock screen is executed or released, when an AOD function is executed or released, when a moving image is executed or released).

In step 1005, the processor 140 may use an output of a specified source amplifier according to the driving frequency and may turn off some source amplifiers. In this step, if the driving frequency is greater than or equal to a specified value, the processor 140 may activate all source amplifiers and may control driving of a display using all the source amplifiers. If the driving frequency is less than the specified value, the processor 140 may turn off some of all the source amplifiers, may turn on a connection switch, and may drive a specified source amplifier in a time-sliced manner, thus providing a necessary source signal to sub-pixels. At least one specified source amplifier may be driven in a time-sliced manner to provide a necessary source signal to a plurality of sub-pixels during one Hsync period.

In step 1007, the processor 140 may determine whether the display configuration is changed. If the display configuration is not changed, the processor 140 may branch back to step 1005. If the display configuration is changed, the processor 140 may branch back to step 1001.

According to various embodiments, a display driving method for providing source signals of a plurality of source amplifiers to a plurality of source line groups in a time-sliced manner in an electronic device including the plurality of source line groups selectively connected with the plurality of source amplifiers and panel switches located between the plurality of source line groups and the plurality of source amplifiers, includes collecting information associated with the display configuration, controlling a turn-on state or a turn-off state of at least one switch which selectively connects output ends of the plurality of source amplifiers based on the information associated with the display configuration and controlling activation or deactivation of at least one source amplifier connected with an output end of a specified source amplifier depending on the turn-on state or the turn-off state of the at least one switch.

A display driving method may further include, if the display configuration is a configuration for driving a display at a specified first driving frequency, driving a display panel based on the switch of the turn-off state.

A display driving method may further include activating the at least one source amplifier selectively connected with the output end of the specified source amplifier.

A display driving method may further include, if the display configuration is a configuration for driving a display at a specified second driving frequency, driving a display panel based on the switch of the turn-on state.

A display driving method may further include deactivating the at least one source amplifier selectively connected with the output end of the specified source amplifier.

A display driving method may further include deactivating a decoder assigned to the at least one deactivated source amplifier.

A display driving method may further include generating a gamma voltage associated with sub-pixels assigned to the at least one deactivated source amplifier and supplying the generated gamma voltage to a decoder assigned to the specified source amplifier.

Figure 11:
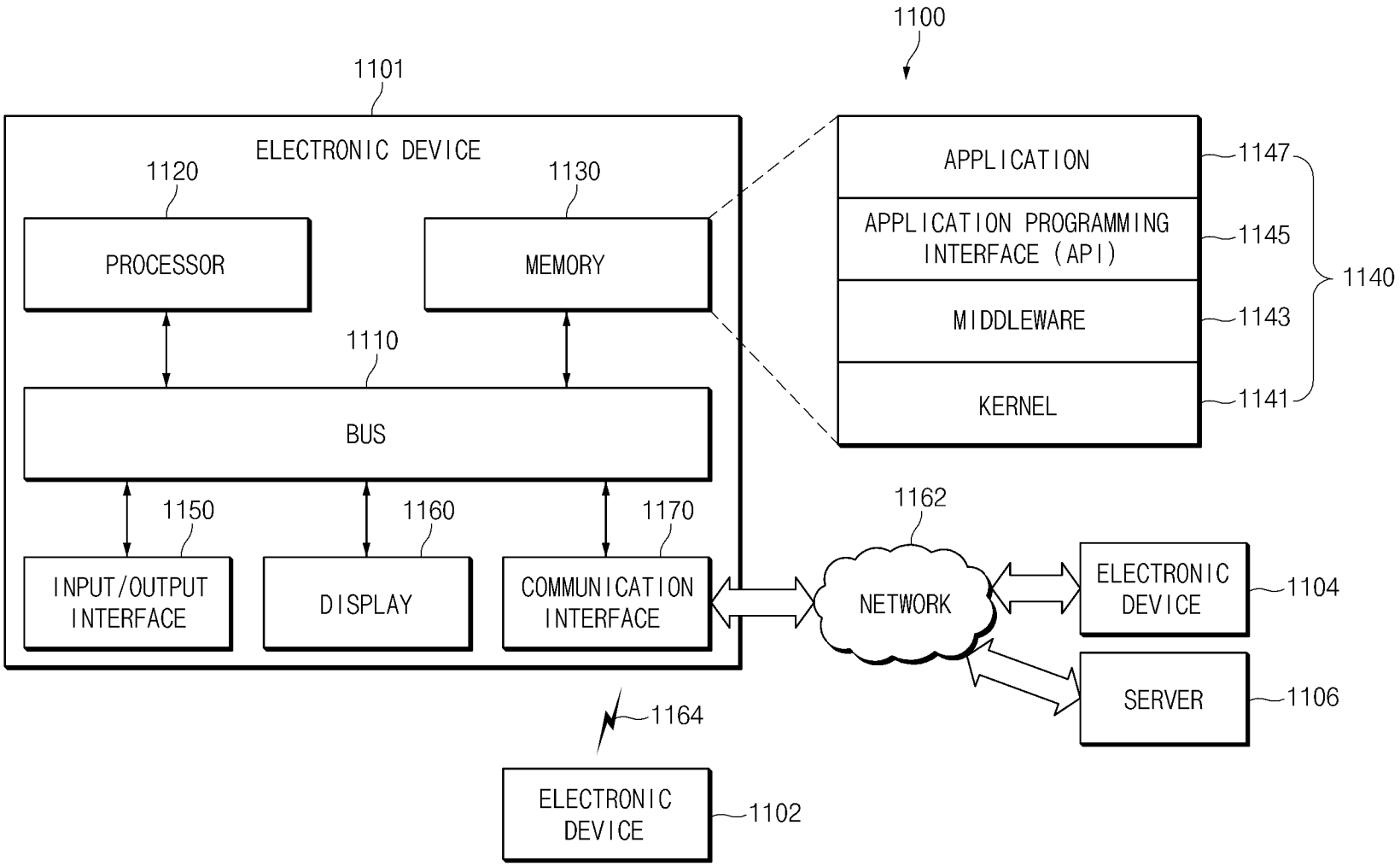
FIG. 11 is a diagram of an electronic device in a network environment, according to an embodiment of the present disclosure.

FIG. 11 is a diagram of an electronic device in a network environment, according to an embodiment of the present disclosure.

Referring to FIG. 11, an electronic device 1101 and a first external electronic device 1102, a second external electronic device 1104, or a server 1106 may connect with each other through a network 1162 or local-area communication 1164. The electronic device 1101 may include a bus 1110, a processor 1120, a memory 1130, an input and output interface 1150, a display 1160, and a communication interface 1170. At least one of the components may be omitted from the electronic device 1101, or other components may be additionally included in the electronic device 1101.

The bus 1110 may be a circuit which connects the components 1120 to 1170 with each other and transmits a communication signal (e.g., a control message and/or data) between the components.

The processor 1120 may include one or more of a CPU, an AP, or a communication processor (CP). The processor 1120 may perform calculation or data processing about control and/or communication of at least another of the components of the electronic device 1101.

The memory 1130 may include a volatile and/or non-volatile memory. The memory 1130 may store a command or data associated with at least another of the components of the electronic device 1101. The memory 1130 may store software and/or a program 1140. The program 1140 may include a kernel 1141, a middleware 1143, an application programming interface (API) 1145, and/or a least one application program 1147 (application 1147). At least part of the kernel 1141, the middleware 1143, or the API 1145 may be referred to as an operating system (OS).

The kernel 1141 may control or manage system resources (e.g., the bus 1110, the processor 1120, or the memory 1130) used to execute an operation or function implemented in the other programs (e.g., the middleware 1143, the API 1145, or the application 1147). Also, as the middleware 1143, the API 1145, or the application 1147 accesses a separate component of the electronic device 1101, the kernel 1141 may provide an interface which may control or manage system resources.

The middleware 1143 may play a role as a go-between such that the API 1145 or the application 1147 communicates with the kernel 1141 to communicate data.

Also, the middleware 1143 may process one or more work requests, received from the application 1147, in order of priority. The middleware 1143 may assign priority which may use system resources (the bus 1110, the processor 1120, or the memory 1130) of the electronic device 1101 to at least one of the at least one application 1147. The middleware 1143 may perform scheduling or load balancing for the one or more work requests by processing the one or more work requests in order of the priority assigned to the at least one of the at least one application 1147.

The API 1145 may be an interface in which the application 1147 controls a function provided from the kernel 1141 or the middleware 1143. The API 1145 may include at least one interface or function (e.g., a command) for file control, window control, image processing, or text control.

The input and output interface 1150 may play a role as an interface which may transmit a command or data input from a user or another external device to another component (or other components) of the electronic device 1101. Also, input and output interface 1150 may output an instruction or data received from another component (or other components) of the electronic device 1101 to the user or the first and second external electronic devices 1102, 1104 or the server 1106.

The display 1160 may include an LCD, an LED display, an OLED display, a microelectromechanical systems (MEMS) display, or an electronic paper display. The display 1160 may display a variety of content (e.g., text, images, videos, icons, or symbols) to the user. The display 1160 may include a touch screen, and may receive a touch, gesture, proximity, or a hovering input using an electronic pen or part of a body of the user.

The communication interface 1170 may establish communication between the electronic device 1101 and the first external electronic device 1102, the second external electronic device 1104, or the server 1106). The communication interface 1170 may connect to the network 1162 through wireless communication or wired communication and may communicate with the second external electronic device 1104 or the server 1106.

The wireless communication may use, for example, at least one of long term evolution (LTE), LTE-advanced (LTE-A), code division multiple access (CDMA), wideband CDMA (WCDMA), universal mobile telecommunications system (UMTS), wireless broadband (WiBro), or global system for mobile communications (GSM) as a cellular communication protocol. Also, the wireless communication may include the local-area communication 1164. The local-area communication 1164 may include, for example, at least one of wireless-fidelity (Wi-Fi) communication, bluetooth (BT) communication, near field communication (NFC), or global navigation satellite system (GNSS) communication.

A magnetic stripe transmission (MST) module may generate a pulse based on transmission data using an electromagnetic signal and may generate a magnetic field signal based on the pulse. The electronic device 1101 may output the magnetic field signal to a POS system. The POS system may restore the data by detecting the magnetic field signal using an MST reader and converting the detected magnetic field signal into an electric signal.

The GNSS may include at least one of a global positioning system (GPS), a Glonass, a Beidou navigation satellite system (Beidou), or a Galileo (i.e., the European global satellite-based navigation system) according to an available area or a bandwidth. Hereinafter, the GPS used herein may be interchangeably with the GNSS. The wired communication may include at least one of, universal serial bus (USB) communication, high definition multimedia interface (HDMI) communication, recommended standard 232 (RS-232) communication, or plain old telephone service (POTS) communication. The network 1162 may include a telecommunications network, for example, at least one of a computer network (e.g., a local area network (LAN) or a wide area network (WAN)), the internet, or a telephone network.

Each of the first and second external electronic devices 1102 and 1104 may be the same as or different device from the electronic device 1101. The server 1106 may include a group of one or more servers. All or some of operations executed in the electronic device 1101 may be executed in the first external electronic device 1102, the second external electronic device 1104, or the server 1106. If the electronic device 1101 should perform any function or service automatically or according to a request, it may request the first external electronic device 1102, the second external electronic device 1104, or the server 106 to perform at least part of the function or service, rather than executing the function or service for itself or in addition to the function or service. The first external electronic device 1102, the second external electronic device 1104, or the server 1106 may execute the requested function or the added function and may transmit the executed result to the electronic device 1101. The electronic device 1101 may process the received result without change or additionally and may provide the requested function or service. For this purpose, cloud computing technologies, distributed computing technologies, or client-server computing technologies may be used.

Figure 12:
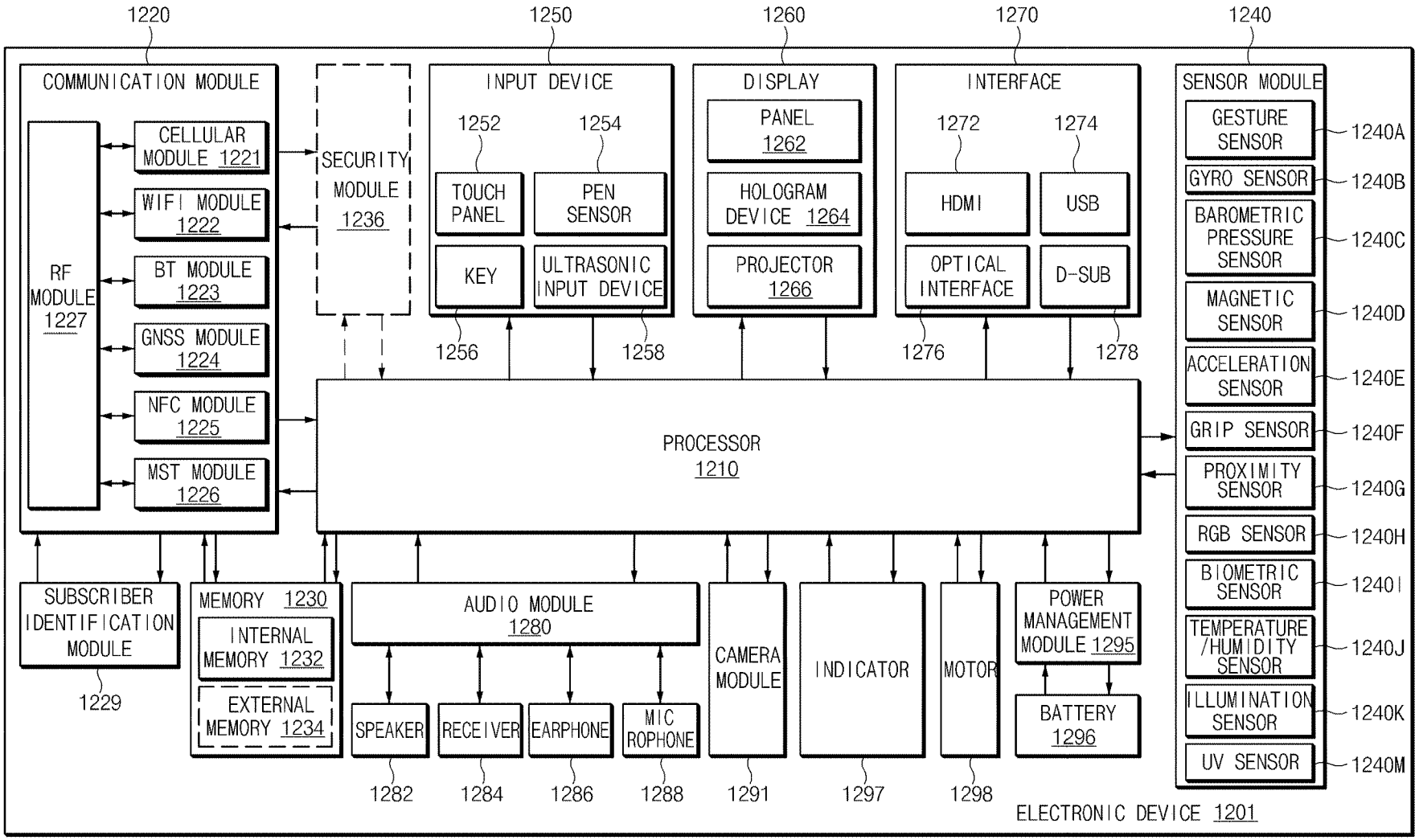
FIG. 12 is a diagram of an electronic device, according to an embodiment of the present disclosure.

FIG. 12 is a diagram of an electronic device, according to an embodiment of the present disclosure.

Referring to FIG. 12, the electronic device 1201 may include all or part of an electronic device 1101 shown in FIG. 11. The electronic device 1201 may include one or more processors 1210 (e.g., application processors (APs)), a communication module 1220, a subscriber identification module (SIM) 1229, a memory 1230, a security module 1236, a sensor module 1240, an input device 1250, a display 1260, an interface 1270, an audio module 1280, a camera module 1291, a power management module 1295, a battery 1296, an indicator 1297, and a motor 1298.

The processor 1210 may drive an OS or an application program to control a plurality of hardware or software components connected thereto and may process and compute a variety of data. The processor 1210 may be implemented with an SoC. The processor 1210 may include a graphic processing unit (GPU) and/or an image signal processor (ISP). The processor 1210 may include at least some (e.g., a cellular module 1221) of the components shown in FIG. 12. The processor 1210 may load a command or data received from at least one of other components (e.g., a non-volatile memory) into a volatile memory to process the data and may store various data in a non-volatile memory.

The communication module 1220 may have the same or similar configuration to a communication interface 1170 of FIG. 11. The communication module 1220 may include the cellular module 1221, a Wi-Fi module 1222, a BT module 1223, a GNSS module 1224 (e.g., a GPS module, a Glonass module, a Beidou module, or a Galileo module), an NFC module 1225, an MST module 1226, and a radio frequency (RF) module 1227.

The cellular module 1221 may provide a voice call service, a video call service, a text message service, or an internet service through a communication network. The cellular module 1221 may identify and authenticate the electronic device 1201 in a communication network using the SIM 1229 (e.g., a SIM card). The cellular module 1221 may perform at least part of functions which may be provided by the processor 1210. The cellular module 1221 may include a CP.

The Wi-Fi module 1222, the BT module 1223, the GNSS module 1224, the NFC module 1225, or the MST module 1226 may include a processor for processing data transmitted and received through the corresponding module. At least some (e.g., two or more) of the cellular module 1221, the Wi-Fi module 1222, the BT module 1223, the GNSS module 1224, the NFC module 1225, or the MST module 1226 may be included in one integrated chip (IC) or one IC package.

The RF module 1227 may transmit and receive a communication signal (e.g., an RF signal). Though not shown, the RF module 1227 may include a transceiver, a power amplifier module (PAM), a frequency filter, or a low noise amplifier (LNA), or an antenna. At least one of the cellular module 1221, the Wi-Fi module 1222, the BT module 1223, the GNSS module 1224, the NFC module 1225, or the MST module 1226 may transmit and receive an RF signal through a separate RF module.

The SIM 1229 may include a card which includes a SIM and/or an embedded SIM. The SIM 1229 may include unique identification information (e.g., an integrated circuit card identifier (ICCID)) or subscriber information (e.g., an international mobile subscriber identity (IMSI)).

The memory 1230 may include an embedded memory 1232 or an external memory 1234. The embedded memory 1232 may include at least one of a volatile memory (e.g., a dynamic random access memory (DRAM), a static RAM (SRAM), a synchronous dynamic RAM (SDRAM)), or a non-volatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory), a hard drive, or a solid state drive (SSD)).

The external memory 1234 may include a flash drive a compact flash (CF), a secure digital (SD), a micro-SD, a mini-SD, an extreme digital (xD), a multimedia car (MMC), or a memory stick. The external memory 1234 may operatively and/or physically connect with the electronic device 1201 through various interfaces.

The secure module 1236 may be a module which has a relatively higher secure level than the memory 1230 and may be a circuit which stores secure data and guarantees a protected execution environment. The secure module 1236 may be implemented with a separate circuit and may include a separate processor. The secure module 1236 may include an embedded secure element (eSE) which is present in a removable smart chip or a removable SD card or is embedded in a fixed chip of the electronic device 1201. Also, the secure module 1236 may be driven by an OS different from the OS of the electronic device 1201. For example, the secure module 1236 may operate based on a Java card open platform (JCOP) OS.

The sensor module 1240 may measure a physical quantity or may detect an operation state of the electronic device 1201, and may convert the measured or detected information to an electric signal. The sensor module 1240 may include at least one of a gesture sensor 1240A, a gyro sensor 1240B, a barometer sensor 1240C, a magnetic sensor 1240D, an acceleration sensor 1240E, a grip sensor 1240F, a proximity sensor 1240G, a color sensor 1240H (e.g., RGB sensor), a biometric sensor 1240I, a temperature/humidity sensor 1240J, an illumination sensor 1240K, or an ultraviolet (UV) sensor 1240M. Additionally or alternatively, the sensor module 1240 may further include, for example, an e-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 1240 may further include a control circuit for controlling at least one or more sensors included therein. The electronic device 1201 may further include a processor configured to control the sensor module 1240, as part of the processor 1210 or to be independent of the processor 1210. While the processor 1210 is in a sleep state, the electronic device 1201 may control the sensor module 1240.

The input device 1250 may include a touch panel 1252, a (digital) pen sensor 1254, a key 1256, or an ultrasonic input device 1258. The touch panel 1252 may use at least one of a capacitive type, a resistive type, an infrared type, or an ultrasonic type. Also, the touch panel 1252 may further include a control circuit. The touch panel 1252 may further include a tactile layer and may provide a tactile reaction to a user.

The (digital) pen sensor 1254 may be part of the touch panel 1252 or may include a separate sheet for recognition. The key 1256 may include a physical button, an optical key, or a keypad. The ultrasonic input device 1258 may allow the electronic device 1201 to detect a sound wave using a microphone 1288 and to verify data through an input tool generating an ultrasonic signal.

The display 1260 may include a panel 1262, a hologram device 1264, or a projector 1266. The panel 1262 may include the same or similar configuration to the display 160 or 1160. The panel 1262 may be implemented to be flexible, transparent, or wearable. The panel 1262 and the touch panel 1252 may be integrated into one module. The hologram device 1264 may show a stereoscopic image in a space using interference of light. The projector 1266 may project light onto a screen to display an image. The screen may be positioned inside or outside the electronic device 1201. The display 1260 may further include a control circuit for controlling the panel 1262, the hologram device 1264, or the projector 1266.

The interface 1270 may include a high-definition multimedia interface (HDMI) 1272, a USB 1274, an optical interface 1276, or a d-subminiature 1278. The interface 1270 may be included in a communication interface 170 or 1170 shown in FIG. 2 or 11, respectively. Additionally or alternatively, the interface 1270 may include a mobile high definition link (MHL) interface, an SD card/multimedia card (MMC) interface, or an infrared data association (IrDA) standard interface.

The audio module 1280 may convert a sound and an electric signal in dual directions. At least part of components of the audio module 1280 may be included in an input and output interface 1150 (or a user interface) shown in FIG. 11. The audio module 1280 may process sound information input or output through a speaker 1282, a receiver 1284, an earphone 1286, or the microphone 1288.

The camera module 1291 may be a device which captures a still image and a moving image. The camera module 1291 may include one or more image sensors (e.g., a front sensor or a rear sensor), a lens, an ISP, or a flash (e.g., an LED or a xenon lamp).

The power management module 1295 may manage power of the electronic device 1201. The power management module 1295 may include a power management integrated circuit (PMIC), a charger IC or a battery gauge. The PMIC may have a wired charging method and/or a wireless charging method. The wireless charging method may include a magnetic resonance method, a magnetic induction method, or an electromagnetic method. An additional circuit for wireless charging, for example, a coil loop, a resonance circuit, or a rectifier may be further provided. The battery gauge may measure the remaining capacity of the battery 1296 and voltage, current, or temperature thereof while the battery 1296 is charged. The battery 1296 may include a rechargeable battery or a solar battery.

The indicator 1297 may display a specific state of the electronic device 1201 or part (e.g., the processor 1210) thereof, for example, a booting state, a message state, or a charging state. The motor 1298 may convert an electric signal into mechanical vibration and may generate vibration or a haptic effect. Though not shown, the electronic device 1201 may include a processing unit (e.g., a GPU) for supporting a mobile TV. The processing unit for supporting the mobile TV may process media data according to standards, for example, a digital multimedia broadcasting (DMB) standard, a digital video broadcasting (DVB) standard, or a mediaFlo™ standard.

Each of the above-mentioned elements of the electronic device 1201 may be configured with one or more components, and names of the corresponding elements may be changed according to the type of the electronic device. The electronic device 1201 may include at least one of the above-mentioned elements, some elements may be omitted from the electronic device 1201, or other additional elements may be further included in the electronic device 1201. Also, some of the elements of the electronic device 1201 may be combined with each other to form one entity, thereby making it possible to perform the functions of the corresponding elements in the same manner as before the combination.

Figure 13:
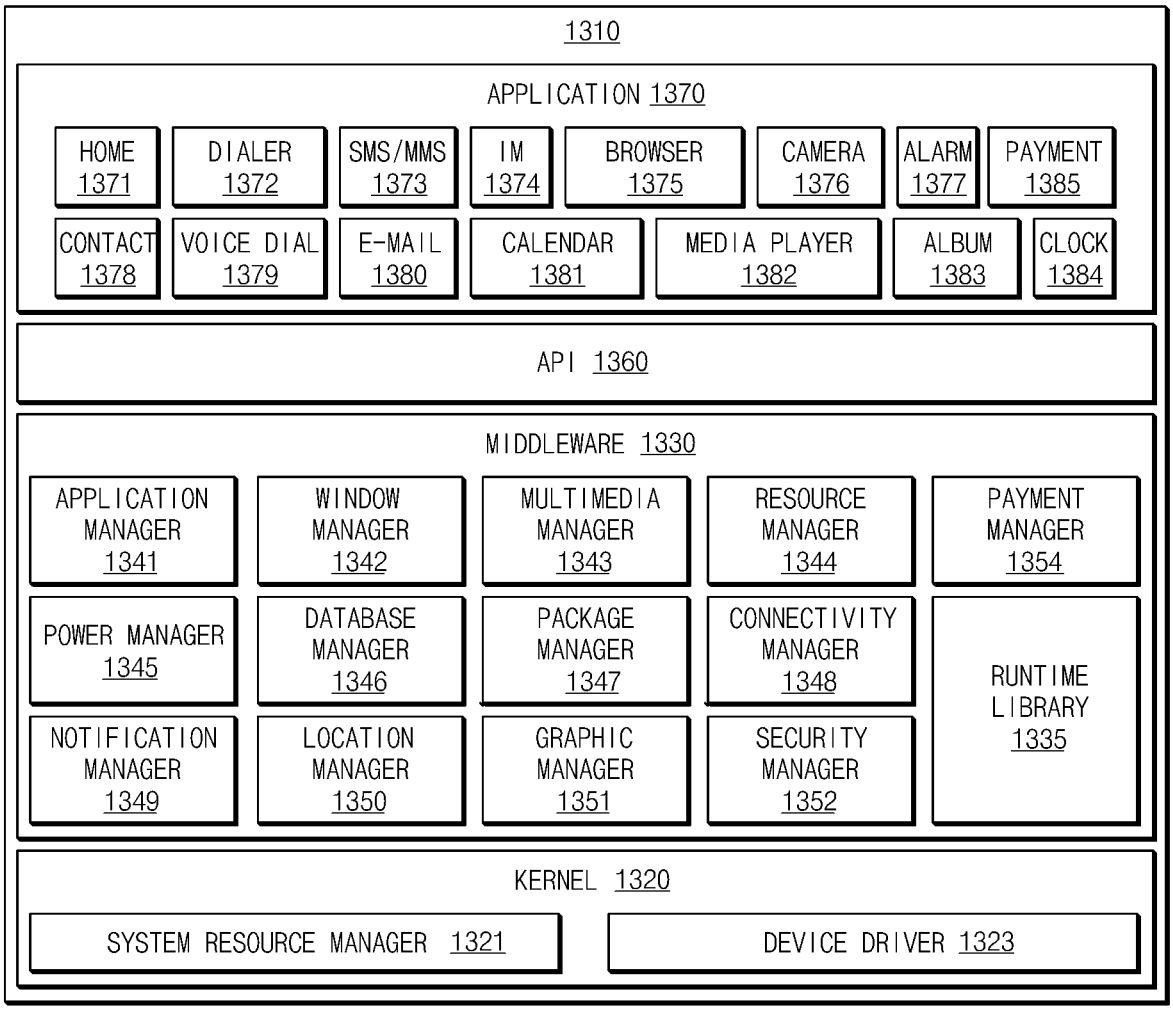
FIG. 13 is a diagram of a program module, according to an embodiment of the present disclosure.

FIG. 13 is a diagram of a program module, according to an embodiment of the present disclosure.

The program module 1310 may include an OS for controlling resources associated with an electronic device (e.g., an electronic device 1101 of FIG. 11) and/or various applications (e.g., an application 1147 of FIG. 11) which are executed on the OS. The OS may be Android™, iOS™, Windows™, Symbian™, Tizen™, or Bada™.

The program module 1310 may include a kernel 1320, a middleware 1330, an application programming interface (API) 1360, and/or an application 1370. At least part of the program module 1310 may be preloaded on the electronic device, or may be downloaded from an external electronic device (e.g., a first external electronic device 1102, a second external electronic device 1104, or a server 1106 of FIG. 11).

The kernel 1320 may include a system resource manager 1321 and/or a device driver 1323. The system resource manager 1321 may control, assign, or collect system resources. The system resource manager 1321 may include a process management unit, a memory management unit, or a file system management unit. The device driver 1323 may include a display driver, a camera driver, a BT driver, a shared memory driver, a USB driver, a keypad driver, a Wi-Fi driver, an audio driver, or an inter-process communication (IPC) driver.

The middleware 1330 may provide functions the application 1370 needs in common, and may provide various functions to the application 1370 through the API 1360 such that the application 1370 efficiently uses limited system resources in the electronic device. The middleware 1330 may include at least one of a runtime library 1335, an application manager 1341, a window manager 1342, a multimedia manager 1343, a resource manager 1344, a power manager 1345, a database manager 1346, a package manager 1347, a connectivity manager 1348, a notification manager 1349, a location manager 1350, a graphic manager 1351, a security manager 1352, or a payment manager 1354.

The runtime library 1335 may include a library module used by a compiler to add a new function through a programming language while the application 1370 is executed. The runtime library 1335 may perform a function about input and output management, memory management, or an arithmetic function.

The application manager 1341 may manage a life cycle of at least one of the application 1370. The window manager 1342 may manage GUI resources used on a screen of the electronic device. The multimedia manager 1343 may determine a format utilized for reproducing various media files and may encode or decode a media file using a codec corresponding to the corresponding format. The resource manager 1344 may manage source codes of at least one of the application 1370, and may manage resources of a memory or a storage space.

The power manager 1345 may act together with, a basic input/output system (BIOS), may manage a battery or a power source, and may provide power information utilized for an operation of the electronic device. The database manager 1346 may generate, search, or change a database to be used in at least one of the application 1370. The package manager 1347 may manage installation or update of an application distributed by a type of a package file.

The connectivity manager 1348 may manage wireless connection such as Wi-Fi connection or BT connection. The notification manager 1349 may display or notify events, such as an arrival message, an appointment, and proximity notification, by a method which is not disturbed to the user. The location manager 1350 may manage location information of the electronic device. The graphic manager 1351 may manage a graphic effect to the user or a user interface (UI) related to the graphic effect. The security manager 1352 may provide all security functions utilized for system security or user authentication. When the electronic device has a phone function, the middleware 1330 may further include a telephony manager for managing a voice or video communication function of the electronic device.

The middleware 1330 may include a middleware module which configures combinations of various functions of the above-described components. The middleware 1330 may provide a module which specializes according to kinds of OSs to provide a differentiated function. Also, the middleware 1330 may dynamically delete some of old components or may add new components.

The API 1360 may be a set of API programming functions, and may be provided with different components according to the type of OS. For example, in case of Android™ or iOS™, one API set may be provided according to platforms. In case of Tizen™, two or more API sets may be provided according to platforms.

The application 1370 may include one or more of a home application 1371, a dialer application 1372, a short message service/multimedia message service (SMS/MMS) application 1373, an instant message (IM) application 1374, a browser application 1375, a camera application 1376, an alarm application 1377, a contact application 1378, a voice dial application 1379, an e-mail application 1380, a calendar application 1381, a media player application 1382, an album application 1383, a clock application 1384, a health care application (e.g., an application for measuring quantity of exercise or blood sugar), or an environment information application (e.g., an application for providing atmospheric pressure information, humidity information, or temperature information).

The application 1370 may include an information exchange application for exchanging information between the electronic device and an external electronic device. The information exchange application may include a notification relay application for transmitting specific information to the external electronic device or a device management application for managing the external electronic device.

The notification relay application may include a function of transmitting notification information, which is generated by other applications (e.g., the SMS/MMS application, the e-mail application, the health care application, or the environment information application) of the electronic device, to the external electronic device. Also, the notification relay application may receive notification information from the external electronic device, and may provide the received notification information to the user of the electronic device.

The device management application may manage (e.g., install, delete, or update) at least one (e.g., a function of turning on/off the external electronic device itself (or partial components) or a function of adjusting brightness (or resolution) of a display) of functions of the external electronic device which communicates with the electronic device, an application which operates in the external electronic device, or a service (e.g., a call service or a message service) provided from the external electronic device.

The application 1370 may include an application (e.g., the health card application of a mobile medical device) which is preset according to attributes of the external electronic device. The application 1370 may include an application received from the external electronic device. The application 1370 may include a preloaded application or a third party application which may be downloaded from a server. Names of the components of the program module 1310 according to various embodiments of the present disclosure may differ according to types of OSs.

At least part of the program module 1310 may be implemented with software, firmware, hardware, or at least two or more combinations thereof. At least part of the program module 1310 may be implemented (e.g., executed) by a processor 1120. At least part of the program module 1310 may include a module, a program, a routine, sets of instructions, or a process for performing one or more functions.

At least part of a device (e.g., modules or the functions) or a method (e.g., operations) may be implemented with, for example, instructions stored in a non-transitory computer-readable storage media which have a program module. When the instructions are executed by a processor, one or more processors may perform functions corresponding to the instructions. The non-transitory computer-readable storage media may be a memory.

The non-transitory computer-readable storage media may include a hard disc, a floppy disk, magnetic media (e.g., a magnetic tape), optical media (e.g., a compact disc read only memory (CD-ROM) and a digital versatile disc (DVD)), magneto-optical media (e.g., a floptical disk), a hardware device (e.g., a ROM, a random access memory (RAM), or a flash memory). Also, the program instructions may include not only mechanical codes compiled by a compiler but also high-level language codes which may be executed by a computer using an interpreter. The above-mentioned hardware device may be configured to operate as one or more software modules to perform operations, and vice versa.

Modules or program modules may include at least one or more of the above-mentioned components, some of the above-mentioned components may be omitted, or other additional components may be further included. Operations executed by modules, program modules, or other components may be executed by a successive method, a parallel method, a repeated method, or a heuristic method. Also, some operations may be executed in a different order or may be omitted, and other operations may be added.

Embodiments of the present disclosure described and shown in the drawings are provided as examples to describe technical content and help understanding but do not limit the present disclosure. Accordingly, it should be interpreted that besides the embodiments listed herein, all modifications or modified forms derived based on the technical ideas of the present disclosure are included in the present disclosure as defined in the claims, and their equivalents.

The above-described embodiments of the present disclosure can be implemented in hardware, firmware or via the execution of software or computer code that can be stored in a recording medium such as a CD ROM, a DVD, a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein.

The control unit may include a microprocessor or any suitable type of processing circuitry, such as one or more general-purpose processors (e.g., ARM-based processors), a digital signal processor (DSP), a programmable logic device (PLD), an ASIC, an FPGA, a GPU, a video card controller, etc. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in whole or in part within the programmed instructions of a computer. In addition, an artisan understands and appreciates that a "processor" or "microprocessor" may be hardware in the claimed disclosure. While the present disclosure has been shown and described with reference to certain embodiments thereof, it will be understood by those skilled in the art that various changes in form and details may be made therein without departing from the scope of the present disclosure. Therefore, the scope of the present disclosure should not be defined as being limited to the embodiments, but should be defined by the appended claims and equivalents thereof.

What is claimed is:

1. An electronic device, comprising:

a display panel including a plurality of source line groups including a plurality of source lines and a plurality of panel switches for each of the plurality of source lines; and a display driver integrated circuit (DDI) configured to drive the display panel, wherein the DDI includes a plurality of source amplifiers, decoders respectively connected to the plurality of source amplifiers, and at least one switch between source amplifier channels, wherein an operation of the at least one switch causes the number of the source line groups corresponding to a source amplifier to be changed by selectively turning on or off the at least one switch that connects between an output stage of the source amplifier and an output stage of another source amplifier adjacent to the source amplifier.

2. The electronic device of claim 1, wherein the display panel comprises a plurality of pixels, each including a stripe type of red, green, and blue sub-pixels, wherein each of the plurality of source amplifiers is selectively connected with 3n sub-pixels, in which n is a natural number.

3. The electronic device of claim 1, further comprising:

a logic circuit configured to provide display data to the decoders, wherein the logic circuit is further configured to:

turn off some of the plurality of source amplifiers in response to a frequency of the display panel; and drive the plurality of source lines based on a specified source amplifier.

4. The electronic device of claim 3, wherein the logic circuit is further configured to:

deactivate decoders assigned to the turned-off source amplifiers.

5. The electronic device of claim 3, wherein the logic circuit is further configured to:

drive the specified source amplifier in a time-sliced manner to provide a specified source signal to the plurality of source line groups.

6. The electronic device of claim 3, further comprising:

a gamma generator configured to supply a gamma voltage to the decoders, wherein the logic circuit is further configured to:

operate the gamma generator in a time-sliced manner to generate at least one gamma voltage corresponding to a red sub-pixel, a green sub-pixel, and a blue sub-pixel and supply the at least one generated gamma voltage to the decoders.

7. The electronic device of claim 6, wherein the display panel comprises a plurality of pixels, each including a PenTile™ type of red, green, blue, and green (RGBG) sub-pixels, and wherein the plurality of source amplifiers comprises:

a first source amplifier that outputs a source signal to a red sub-pixel and a blue sub-pixel with respect to each of the plurality of pixels; and a second source amplifier that outputs a source signal to a first green sub-pixel and a second green sub-pixel with respect to each of the plurality of pixels.

8. The electronic device of claim 7, wherein the gamma generator comprises:

a first gamma voltage generator configured to generate and supply a gamma voltage corresponding to the red sub-pixel and the blue sub-pixel to a decoder connected to the first source amplifier; and a second gamma voltage generator configured to generate and supply a gamma voltage corresponding to the first green sub-pixel and the second green sub-pixel to a decoder connected to the second source amplifier.

9. An electronic device, comprising:

a display panel including a plurality of source line groups including a plurality of source lines and a plurality of panel switches for each of the plurality of source lines; and a display driver integrated circuit (DDI) configured to drive the display panel, wherein the DDI includes a plurality of source amplifiers, decoders respectively connected to the plurality of source amplifiers, and at least one switch between source amplifier channels, wherein the DDI is configured to:

provide each source signal of the plurality of source amplifiers to n sub pixels, in which n is a natural number, during a 1 v-sync period of the display panel while the display panel is operating in a normal power mode, and provide a source signal of one source amplifier of the plurality of source amplifiers to at least N sub pixels, in which N is a natural number and is greater than 1, during a 1 v-sync period of the display panel while the display panel is operating in a low power mode based on an operation of at least one switch connected between some of the plurality of source amplifiers.

10. The electronic device of claim 9, wherein the display panel comprises a plurality of pixels, each including a stripe type of red, green, and blue sub-pixels, wherein each of the plurality of source amplifiers is selectively connected with 3n sub-pixels, in which n is a natural number.

11. The electronic device of claim 9, further comprising:

a logic circuit configured to provide display data to the decoders, wherein the logic circuit is further configured to:

turn off the some of the plurality of source amplifiers in response to a frequency of the display panel; and drive the plurality of source lines based on a specified source amplifier.

12. The electronic device of claim 11, wherein the logic circuit is further configured to:

deactivate decoders assigned to the turned-off source amplifiers.

13. The electronic device of claim 11, wherein the logic circuit is further configured to:

drive the specified source amplifier in a time-sliced manner to provide a specified source signal to the plurality of source line groups.

14. The electronic device of claim 11, further comprising:

a gamma generator configured to supply a gamma voltage to the decoders, wherein the logic circuit is further configured to:

operate the gamma generator in a time-sliced manner to generate at least one gamma voltage corresponding to a red sub-pixel, a green sub-pixel, and a blue sub-pixel and supply the at least one generated gamma voltage to the decoders.

15. The electronic device of claim 14, wherein the display panel comprises a plurality of pixels, each including a PenTile™ type of red, green, blue, and green (RGBG) sub-pixels, and wherein the plurality of source amplifiers comprises:

a first source amplifier that outputs a source signal to a red sub-pixel and a blue sub-pixel with respect to each of the plurality of pixels; and a second source amplifier that outputs a source signal to a first green sub-pixel and a second green sub-pixel with respect to each of the plurality of pixels.

16. The electronic device of claim 15, wherein the gamma generator comprises:

a first gamma voltage generator configured to generate and supply a gamma voltage corresponding to the red sub-pixel and the blue sub-pixel to a decoder connected to the first source amplifier; and a second gamma voltage generator configured to generate and supply a gamma voltage corresponding to the first green sub-pixel and the second green sub-pixel to a decoder connected to the second source amplifier.

* * * * *